US006874429B2

(12) United States Patent
Bosman et al.

(10) Patent No.: US 6,874,429 B2
(45) Date of Patent: Apr. 5, 2005

(54) SUPPORT FOR A COMPUTER KEYBOARD AND MOUSE

(75) Inventors: Scott A. Bosman, Green Bay, WI (US); Frederick P. Bohl, Neenah, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 10/465,449

(22) Filed: Jun. 19, 2003

(65) Prior Publication Data

US 2003/0227210 A1 Dec. 11, 2003

Related U.S. Application Data

(62) Division of application No. 09/691,892, filed on Oct. 19, 2000, now Pat. No. 6,604,784.

(51) Int. Cl.[7] ..... A47B 57/00

(52) U.S. Cl. ..... 108/59; 108/137; 108/143; 108/26; 312/301; 312/208.1; 312/298

(58) Field of Search ..... 312/208.1, 223.1, 312/298, 235.1; 108/301, 102, 137, 143, 26, 60, 59; 248/188.4, 118; 52/36.1

(56) References Cited

U.S. PATENT DOCUMENTS

| | | | |
|---|---|---|---|
| D101,639 | S | 10/1936 | Larsen |
| 2,140,635 | A | 12/1938 | Konarski |
| 2,162,560 | A | 6/1939 | Larsen |
| 2,287,614 | A | 6/1942 | Hawkins |
| D149,652 | S | 5/1948 | Kipp |
| D149,982 | S | 6/1948 | Sundberg |
| 2,459,257 | A | 1/1949 | Wood |
| D156,695 | S | 1/1950 | Brafman |
| D159,992 | S | 9/1950 | Kump, Jr. |
| D169,012 | S | 3/1953 | Musacco |
| 2,632,496 | A | 3/1953 | Willis et al. |
| 2,643,703 | A | 6/1953 | Willis et al. |
| 2,661,049 | A | 12/1953 | Sebel |
| 2,676,646 | A | 4/1954 | Brashear, Jr. |
| D175,833 | S | 10/1955 | Gratz |
| D178,989 | S | 10/1956 | Eilert |
| D226,066 | S | 1/1973 | Barecki |
| 3,825,302 | A | 7/1974 | Kurtz |
| D240,483 | S | 7/1976 | Sklaroff |
| 4,097,089 | A | 6/1978 | Petersen |
| D249,989 | S | 10/1978 | Radaelli |
| 4,305,617 | A | 12/1981 | Benoit |
| D271,448 | S | 11/1983 | Crockett |
| D283,563 | S | 4/1986 | Arroyo |
| 4,881,776 | A | 11/1989 | Wang |

(Continued)

FOREIGN PATENT DOCUMENTS

| | | |
|---|---|---|
| DE | 86 11 643 | 6/1985 |
| DE | 93 00 705 | 11/1993 |
| FR | 720781 | 2/1932 |
| IT | 579968 | 7/1958 |

*Primary Examiner*—Peter M. Cuomo
*Assistant Examiner*—Erika Garrett
(74) *Attorney, Agent, or Firm*—Boyle, Fredrickson, Newholm, Stein & Gratz, S.C.

(57) ABSTRACT

A furniture construction includes a frame structure made up of a pair of spaced frame sections connected together, and a furniture component mounted to the frame structure. Each frame section includes a lower base section, an upright, and a furniture component support member extending from the upright and to which the furniture component is mounted. The frame sections are preferably C-shaped when viewed from the side. In one form, the furniture component is a seat mounted to the furniture component support, and the frame structure includes a back support area extending upwardly from the seat. A back is mounted to the back support area. In another form, the furniture component is a desk or table top mounted to the furniture component support. Combination desk/chair units may also be constructed utilizing the same basic frame structure.

14 Claims, 21 Drawing Sheets

U.S. PATENT DOCUMENTS

D307,837 S 5/1990 Grant
5,429,337 A * 7/1995 Poole ..... 248/442.2
5,572,935 A * 11/1996 Schairbaum ..... 108/1
5,626,394 A 5/1997 Perry
5,692,815 A * 12/1997 Murphy ..... 312/283
6,039,392 A 3/2000 Dencker
6,045,098 A * 4/2000 Timm ..... 248/118
6,079,676 A * 6/2000 Hackett et al. ..... 248/118
6,092,883 A * 7/2000 Lechman ..... 312/194
6,099,093 A * 8/2000 Spence ..... 312/196
6,158,829 A * 12/2000 Nielsen ..... 312/208.1
6,454,370 B1 * 9/2002 Mosnik ..... 312/223.3
6,505,566 B1 * 1/2003 Foster et al. ..... 108/138
6,527,234 B1 * 3/2003 Kovacik ..... 248/118.1
6,626,686 B1 * 9/2003 D'Souza et al. ..... 439/131
6,694,895 B2 * 2/2004 Gillis ..... 108/102

* cited by examiner

FIG. 1
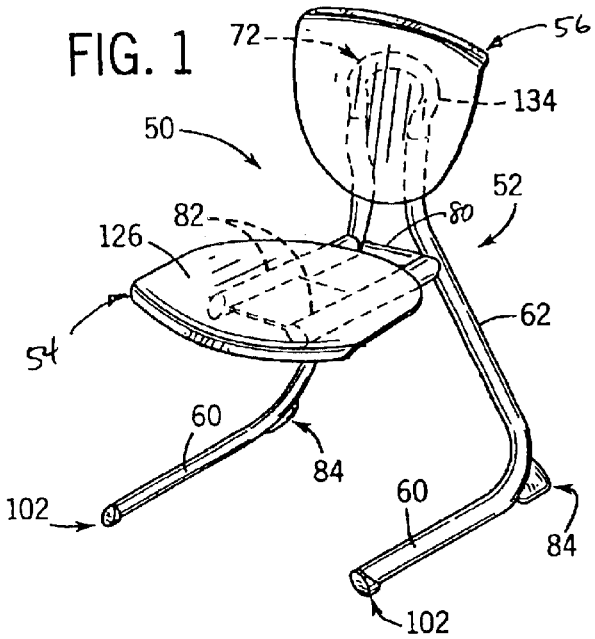
FIG. 2
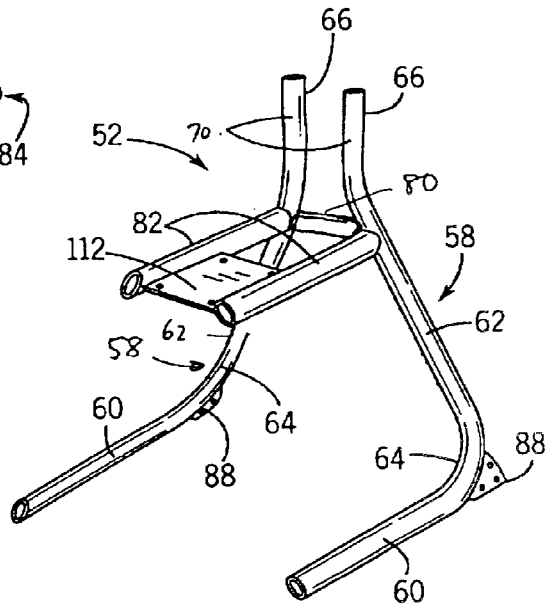
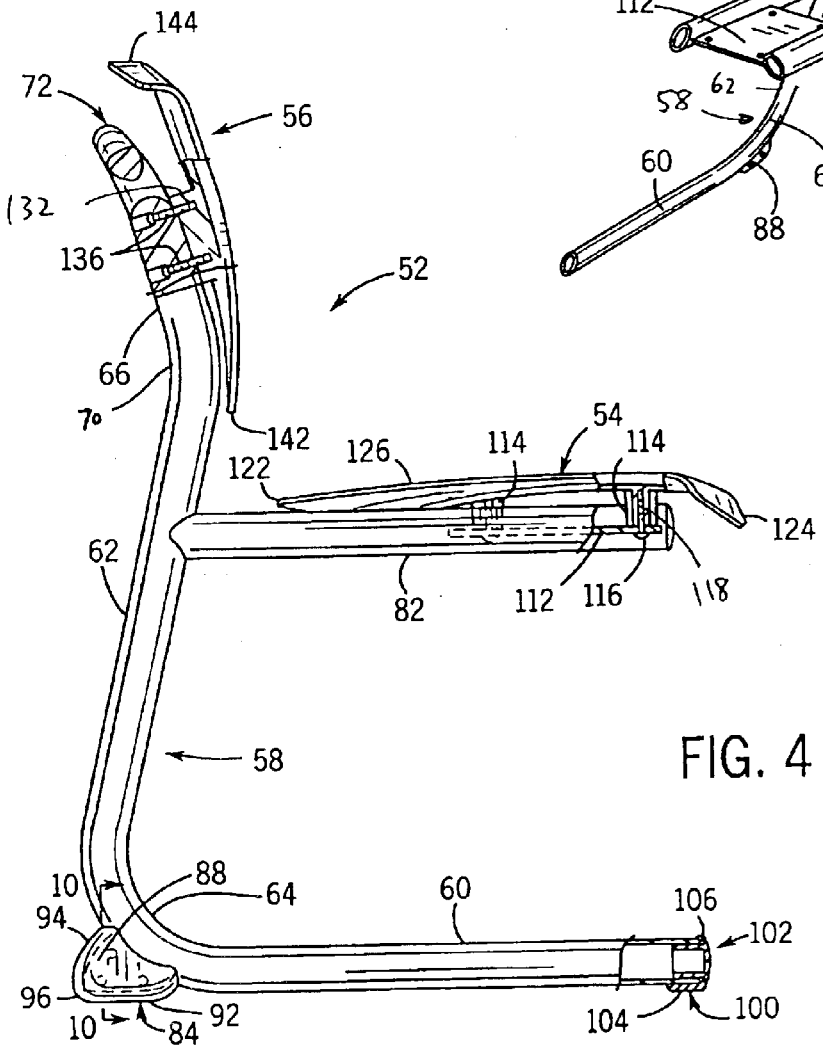
FIG. 4

FIG. 6
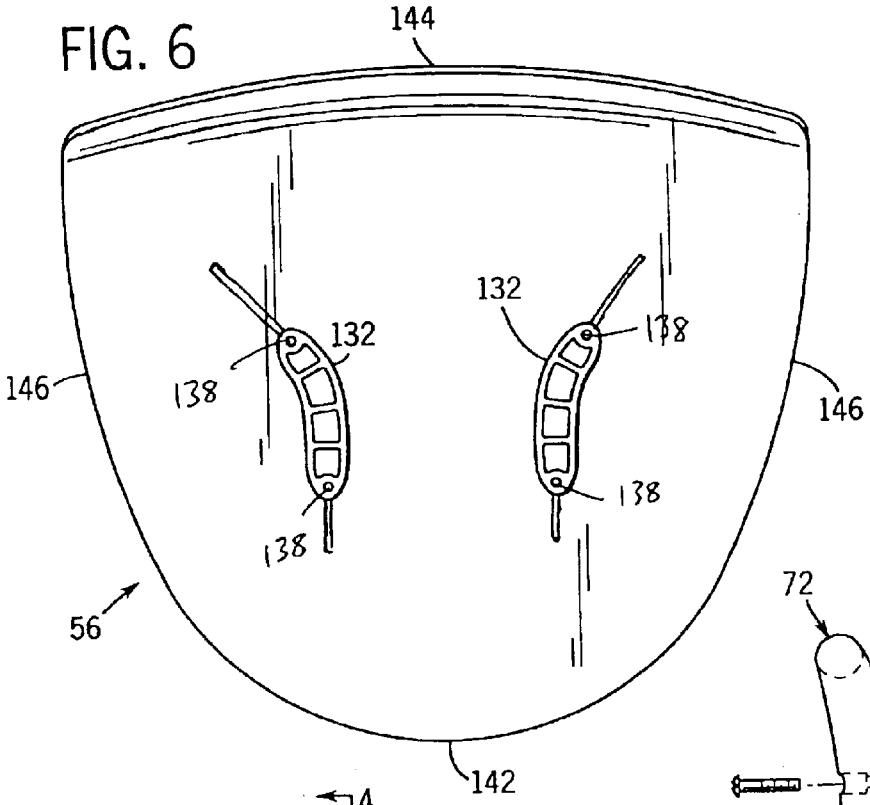
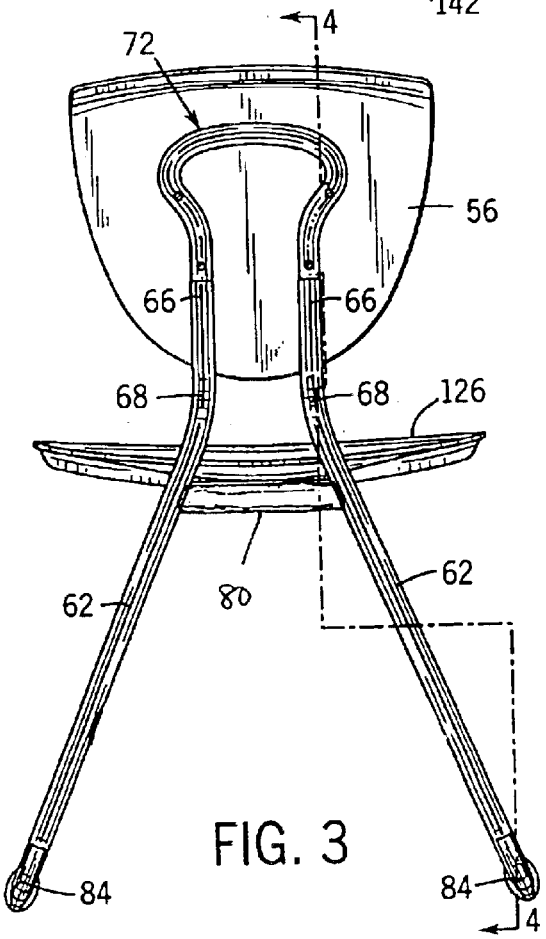
FIG. 3
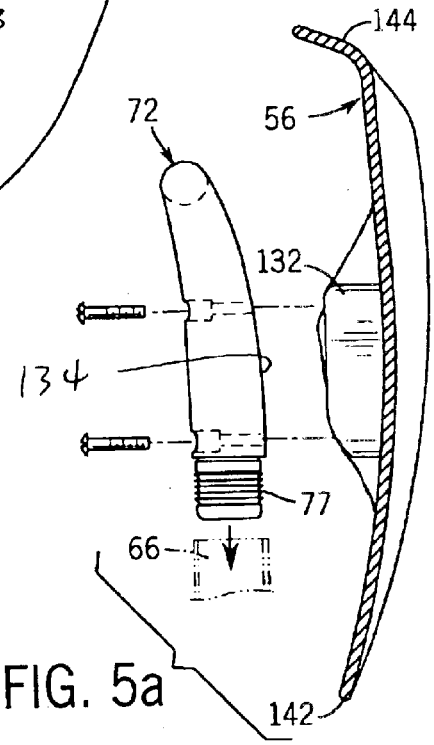
FIG. 5a
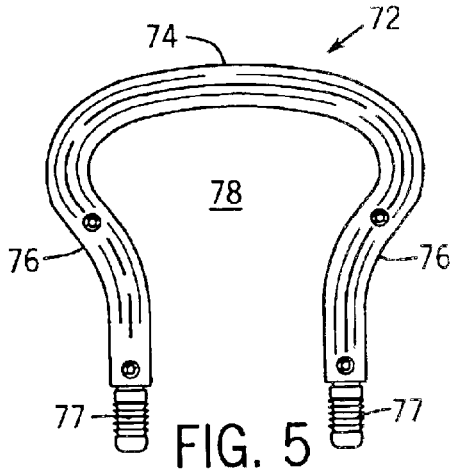
FIG. 5

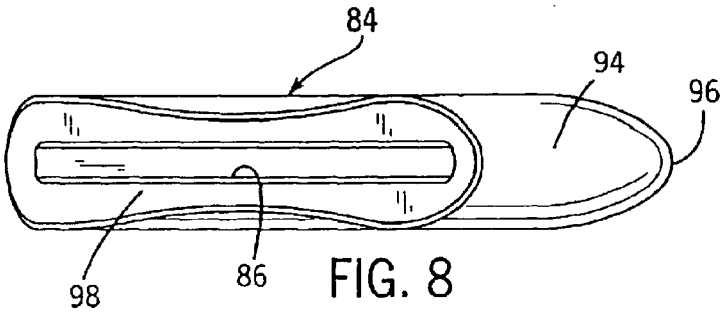
FIG. 8
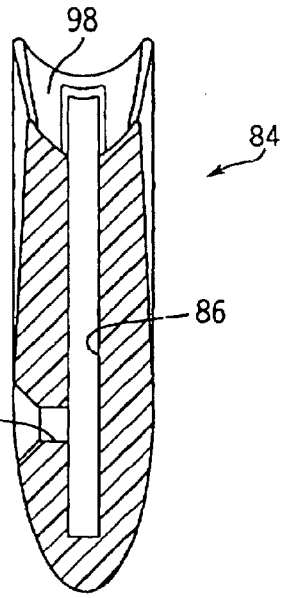
FIG. 9
FIG. 10
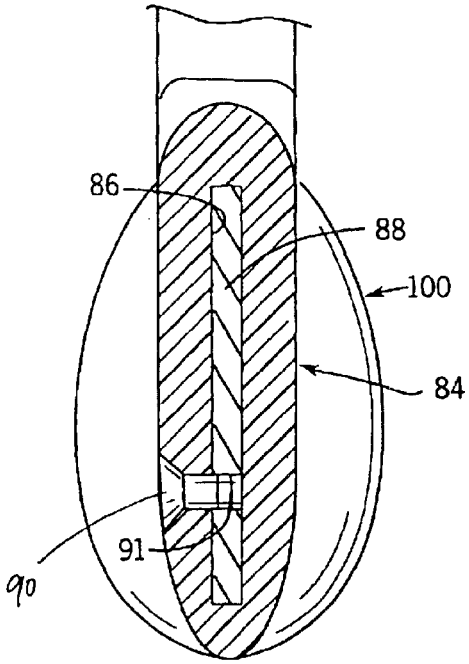
FIG. 11
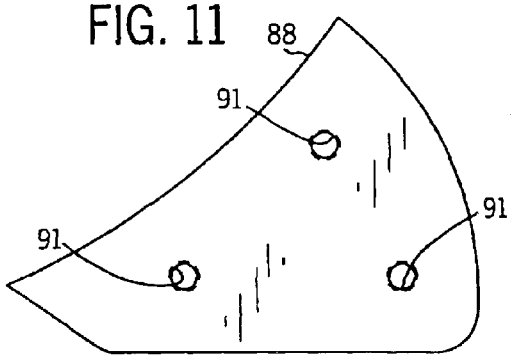
FIG. 7
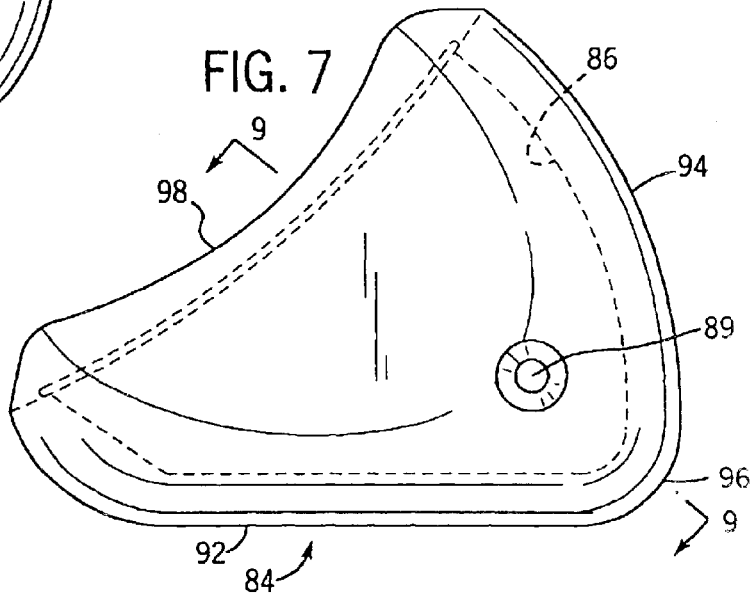

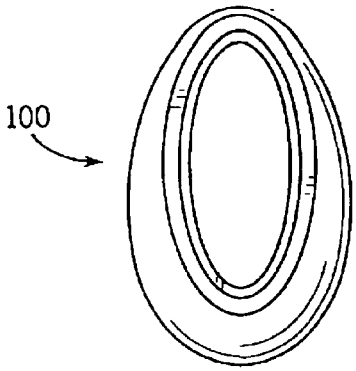
FIG. 13
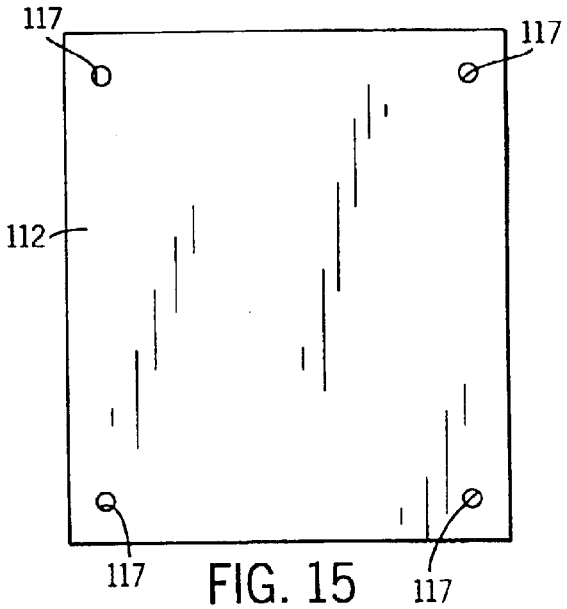
FIG. 15
FIG. 14
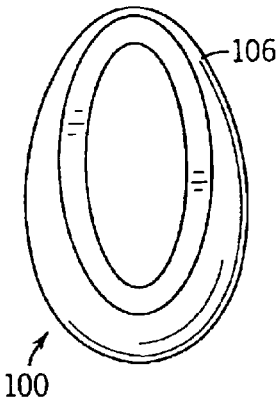
FIG. 12
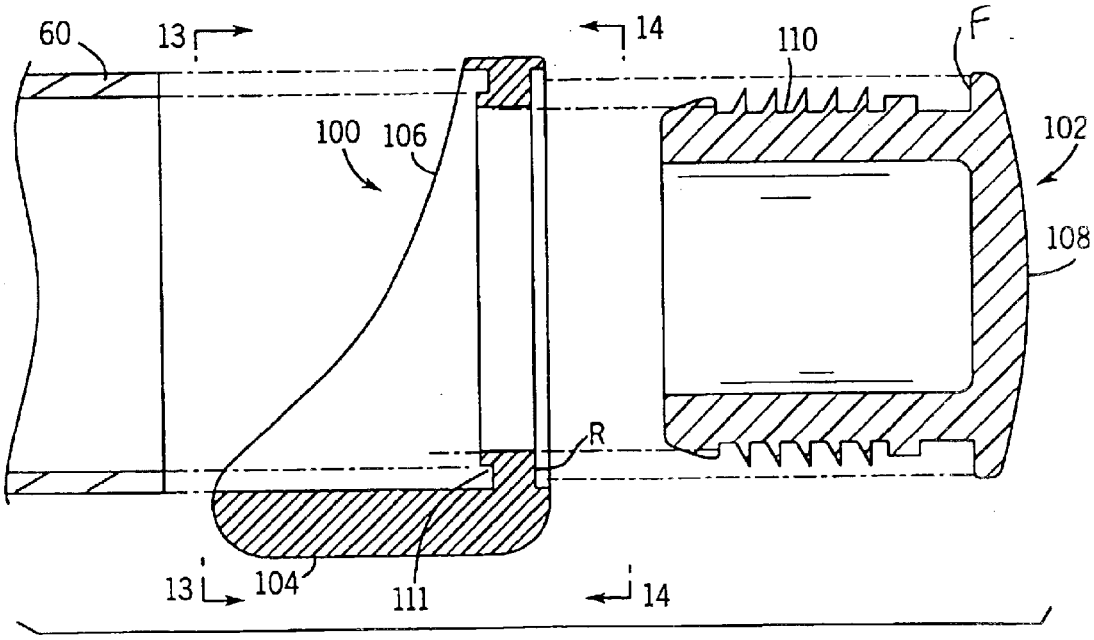

FIG. 16
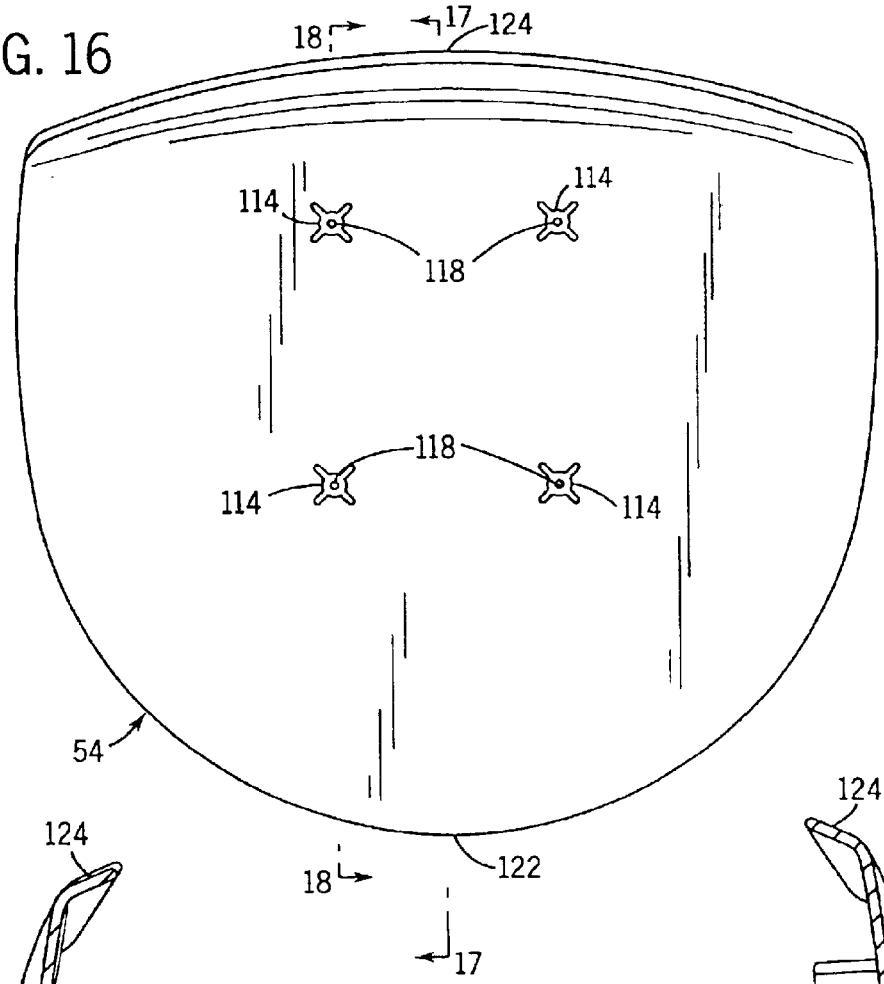
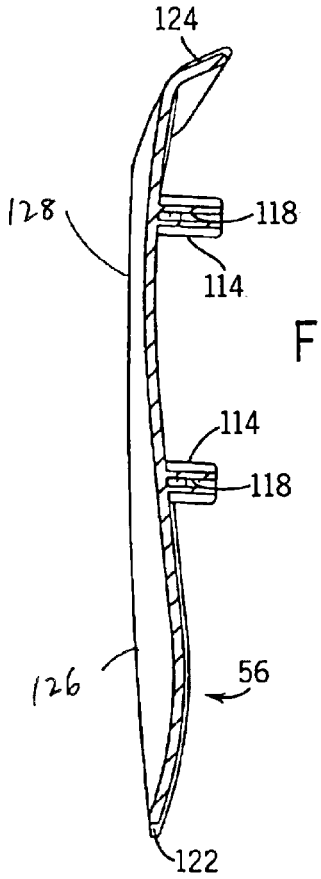
FIG. 18
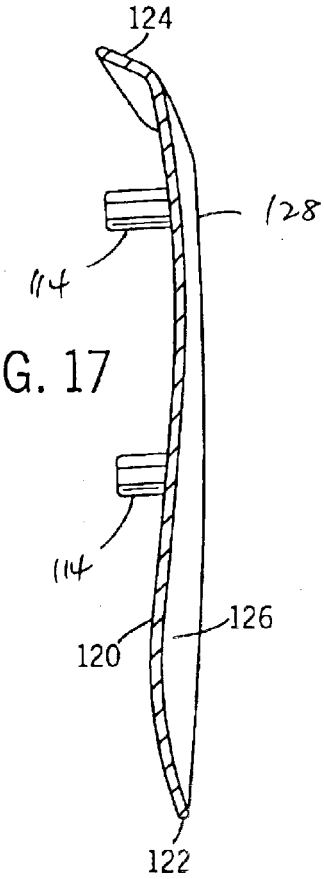
FIG. 17

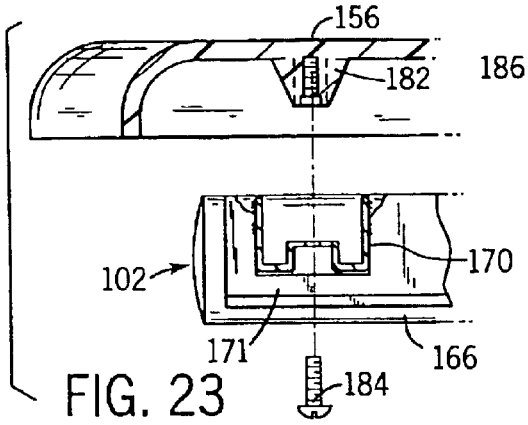
FIG. 23
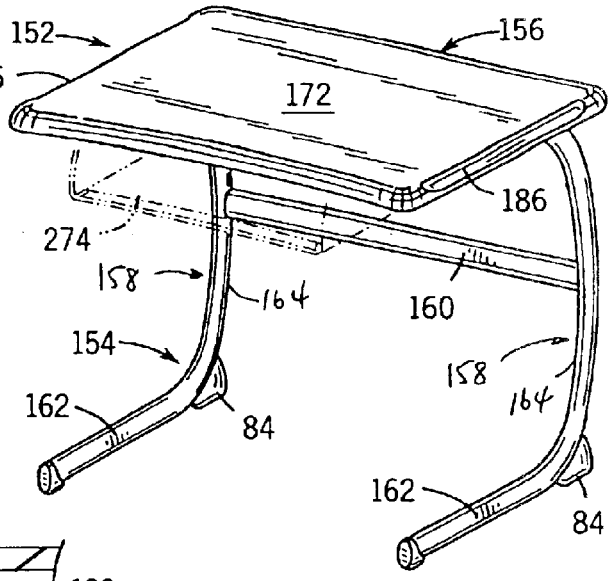
FIG. 21
FIG. 24
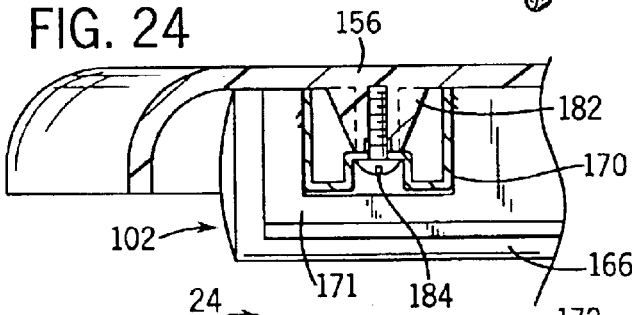
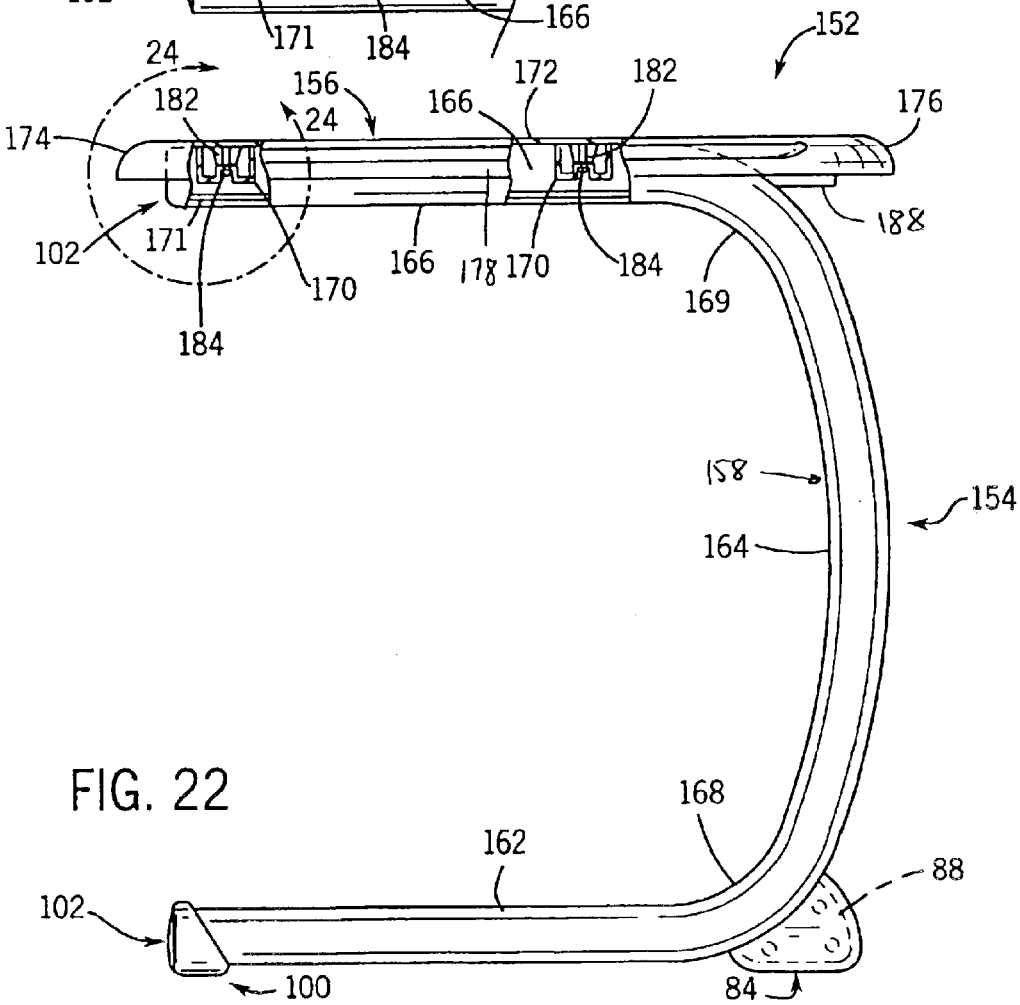
FIG. 22

FIG. 29
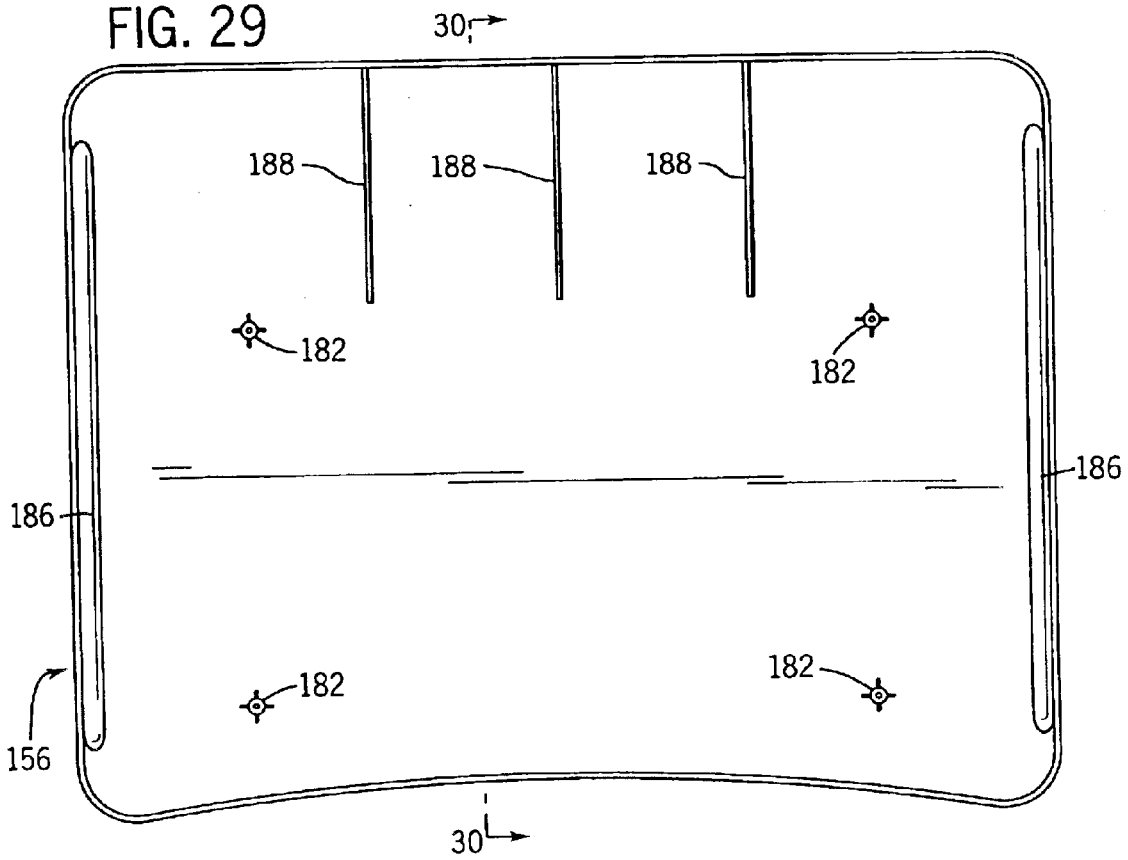
FIG. 30
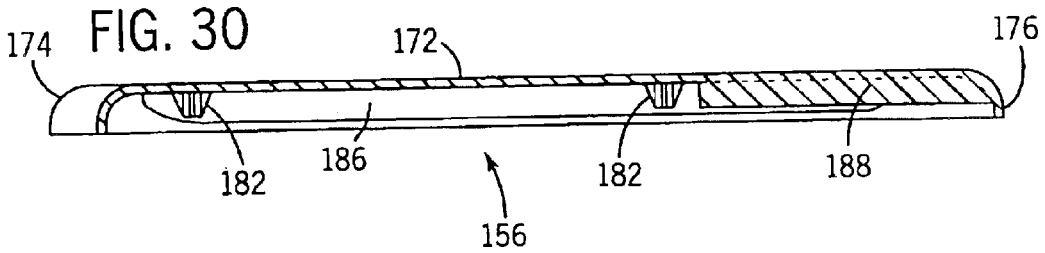
FIG. 31
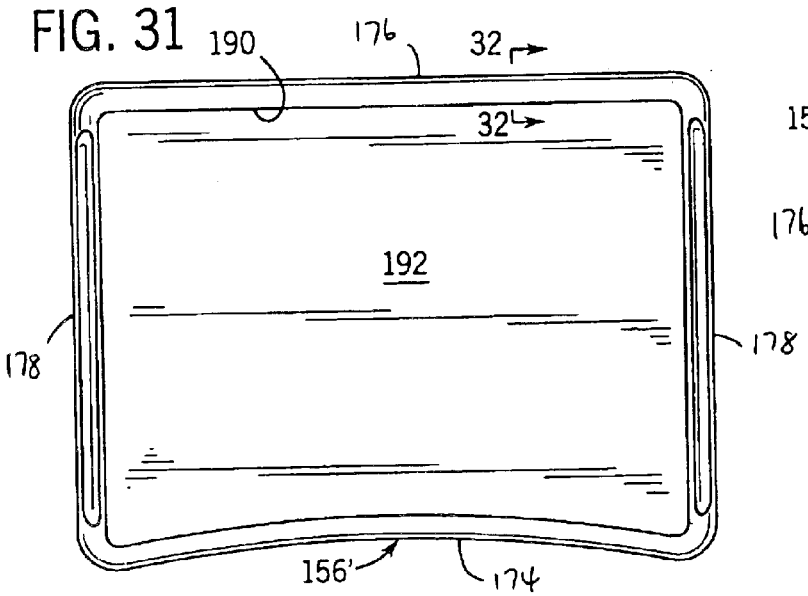
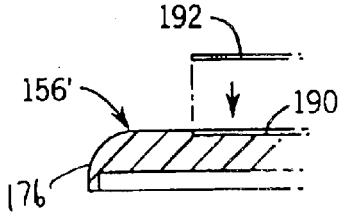
FIG. 32

FIG. 41
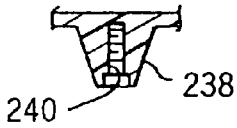
FIG. 39
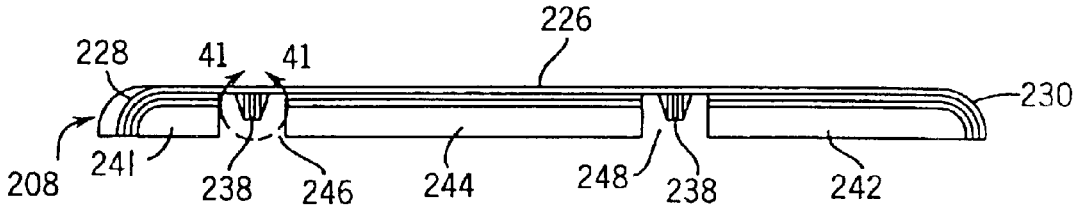
FIG. 40
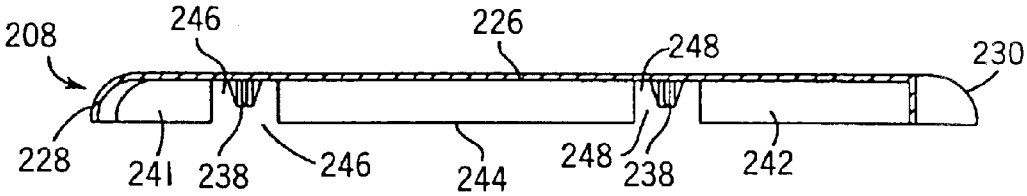
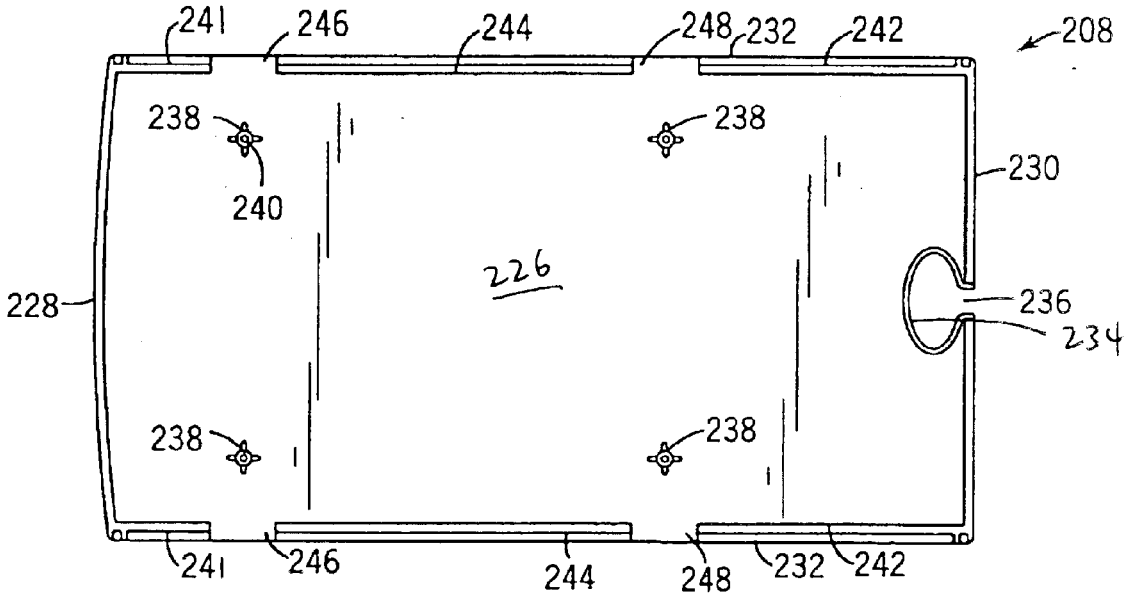
FIG. 38

FIG. 44
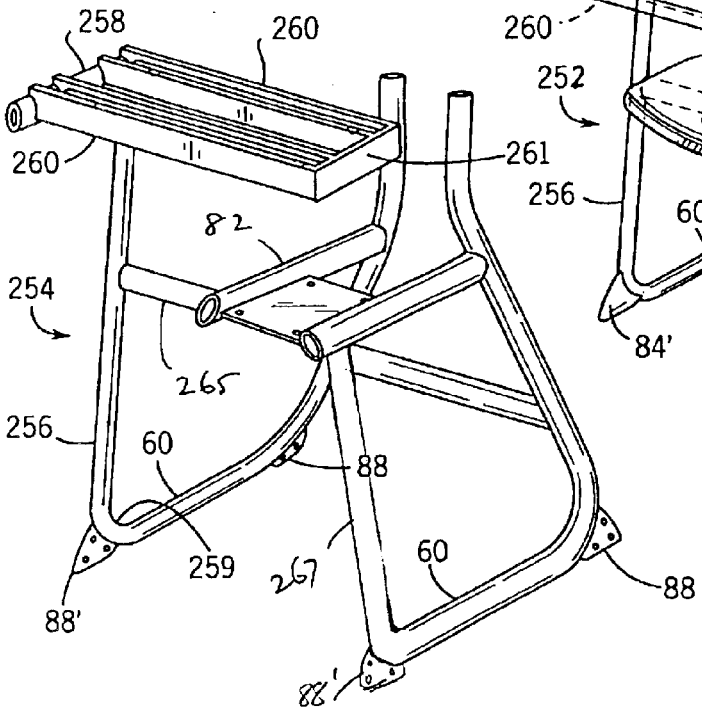
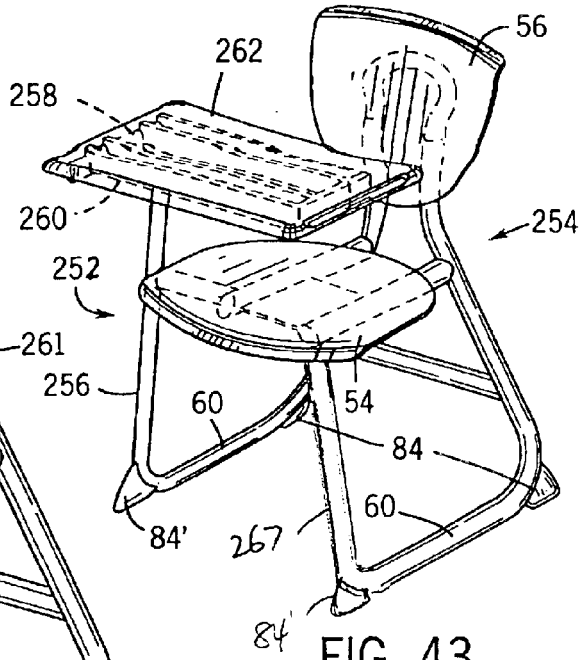
FIG. 43
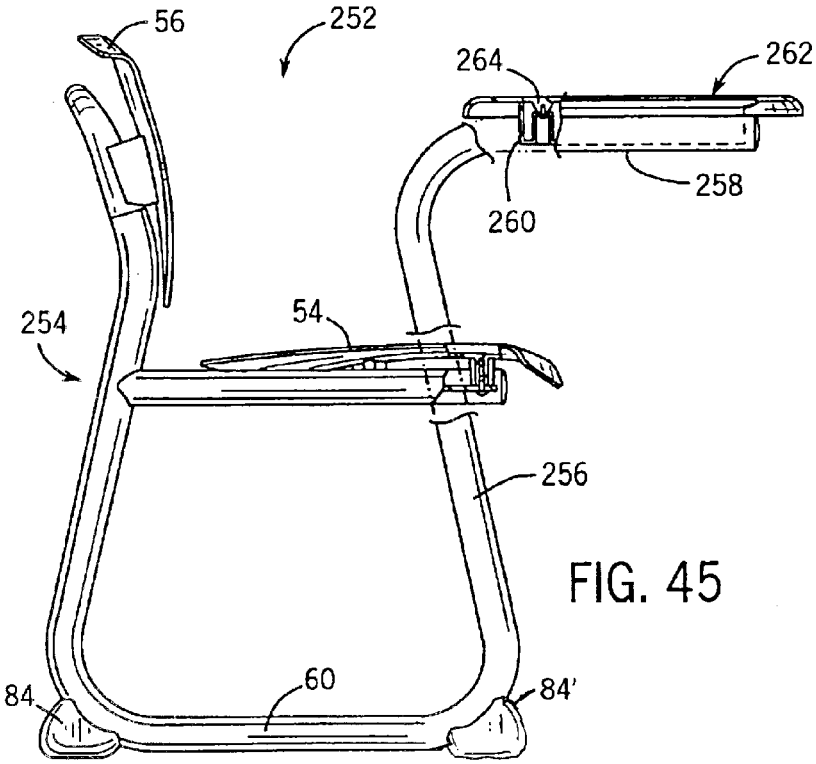
FIG. 45

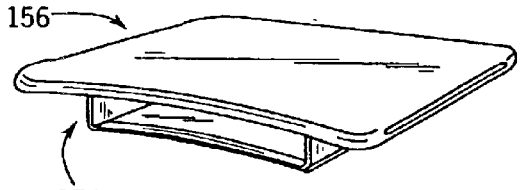
FIG. 57
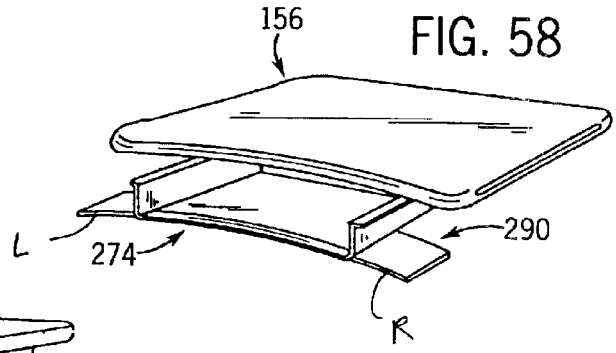
FIG. 58
FIG. 59
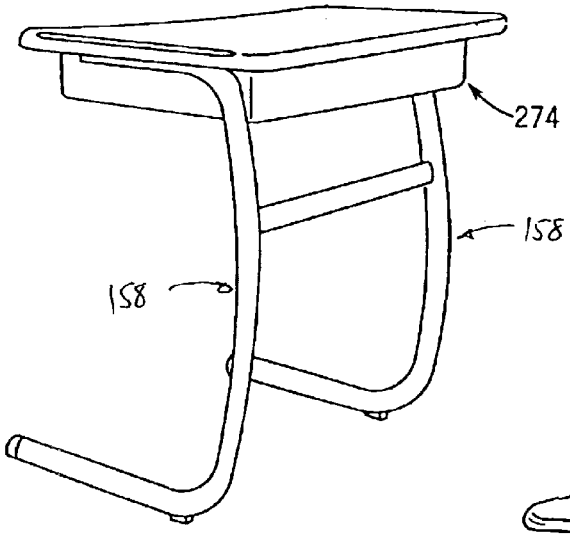
FIG. 60
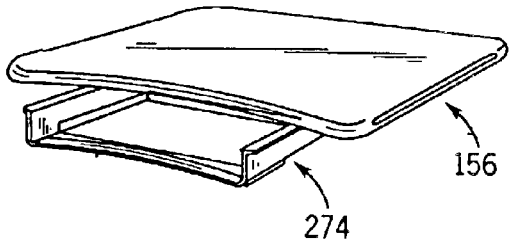
FIG. 62
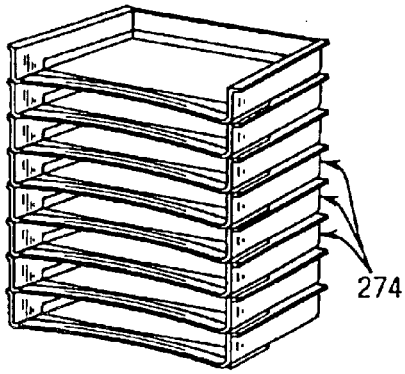
FIG. 61
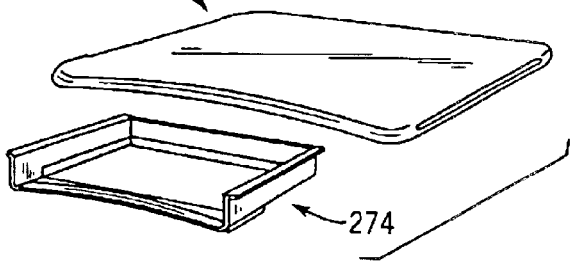

SUPPORT FOR A COMPUTER KEYBOARD AND MOUSE

CROSS-REFERENCE TO RELATED APPLICATION

This application is a divisional of application Ser. No. 09/691,892 filed Oct. 19, 2000 now U.S. Pat. No. 6,604,784.

This application is based on and claims the benefit of provisional application Ser. No. 60/160,348 filed Oct. 19, 1999.

BACKGROUND AND SUMMARY OF THE INVENTION

This invention pertains to a chair and desk system which is well suited for use in an educational environment. The system includes chairs, desks, chair/desk combinations and accessories for use therewith.

Furniture used in educational settings, such as classrooms in primary and secondary schools, typically consists of combination desk/chair units or a series of tables in which students are seated in individual chairs. Combination desk/chair units are typically employed in primary classrooms, and include a frame having a set of rear legs and a set of front legs. A seat is mounted to a seat support structure interconnected with the rear of the frame, and a desk is supported by a desk support structure located at the front of the frame. This type of construction is old and well-known, and has been used in classrooms for many decades.

Educational tables and chairs, which are used in other types of classrooms, are also typically constructed in a manner that is old and well-known. Tables typically consist of a rectangular laminated top with a leg supporting the top at each corner. Chairs are typically constructed of thick, hard plastic seats and backs which are mounted to a four-legged frame which includes a seat mounting area and a back mounting area.

It is an object of the present invention to advance the design, function, manufacture and aesthetic characteristics of furniture which is typically employed in a classroom setting. It is a further object of the invention to provide such furniture which incorporates similar design elements for desks, chairs, chair/desk combinations and tables, which departs significantly from existing technology and which provides significant advantages in use, manufacture and aesthetics. A still further object of the invention is to provide such furniture which is readily adaptable for manufacture in varying sizes so as to accommodate differently sized users encountered in different educational settings. Yet another object of the invention is to provide such furniture which has ergonomic advantages over the prior art. A still further object of the invention is to provide such furniture which is relatively simple in its components and manufacture, and which utilizes a number of common components so as to reduce the cost of manufacturing furniture of varying sizes.

In accordance with the invention, an article of furniture is made up of a supporting frame assembly and a furniture component mounted to the frame assembly. The frame assembly is substantially C-shaped when viewed from the side, and includes a pair of interconnected C-shaped side frame sections. Each side frame section includes a lower member which engages the floor or other supporting surface, an upright member extending upwardly from one end of the lower member, and an upper member which supports a component of the article of furniture. This construction of the frame assembly can be used to form a chair or a desk, and the open area of the frame assembly faces the area occupied by the user's legs. That is, the C-shaped frame assembly of the chair faces forwardly and the C-shaped frame assembly of a desk faces rearwardly, to maximize the amount of leg room available for a user.

A chair constructed according to the invention has a seat supported by the upper members of the side frame sections. Each side frame section further includes an extension of the upright member which extends above the seat, and defines an area to which a back is mounted. In addition, the upper ends of the side frame sections are interconnected by an inverted U-shaped handle member, which is located behind the back.

The side frame sections are constructed such that each lower member extends forwardly from the lower end of the upright member, such as at a bend located between the lower member and the upright member. A glide is mounted to each side frame section at the bend, and is adapted to engage the floor or other supporting surface at a location rearwardly of the user's center of gravity. In a preferred form, the glide engages the floor at a location rearwardly of the back. In this manner, the chair is resistant to tipping when the forward portion of the chair is raised.

The back is designed such that its maximum width is at the upper end of the back, with the sides of the back being arcuate in shape and extending downwardly from the upper end of the back. The seat and the back define surfaces which support the user at an optimal seating angle and which provide comfort during long periods of setting.

In a desk assembly, a desk top is mounted to the upper support members. The side frame sections are parallel to each other and extend in a vertical plane, and function to support the desk top above the floor or other supporting surface. Each side frame section includes a lower member which engages the floor and an upright extending upwardly therefrom, with the upper member extending from the upper end of the upright in a direction parallel to the lower member. The desk frame and top may have a construction suitable for a single student. Alternatively, the frame may be formed to have a greater length and to support a double desk top, to provide a double desk construction.

The invention further contemplates a tablet desk in which an upright member extends upwardly from the forward end of one of the lower members. A tablet support frame is engaged with the upright member and is located over the seat, and a tablet top is mounted to the tablet frame so as to be spaced above and forwardly of the seat. The same basic construction of the chair frame assembly is employed to construct a tablet desk of this type.

The invention further contemplates a double entry desk having a chair frame and a desk frame which are merged together, such that the lower member of each chair side frame section is formed continuously with the lower member of each desk side frame section. With this construction, the desk top is permanently mounted in a fixed location above and forwardly of the seat, and the user can enter or exit the combination desk/chair assembly from either side.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view of a chair assembly constructed according to the invention;

FIG. 2 is an isometric view of the frame of the chair assembly of FIG. 1;

FIG. 3 is a rear plan view of the chair assembly of FIG. 1;

FIG. 4 is a side elevation view, with portions in section, of the chair assembly of FIG. 1;

FIG. 5 is an elevation view of a handle member forming a part of the chair assembly of FIG. 1, for interconnecting the upper ends of the chair frame of FIG. 2;

FIG. 5*a* is a partial exploded elevation view illustrating mounting of the chair back to the handle member of FIG. 5;

FIG. 6 is a rear elevation view of the chair back incorporated in the chair assembly of FIG. 1;

FIG. 7 is an elevation view of a glide member incorporated in the chair assembly of FIG. 1;

FIG. 8 is a top plan view of the glide member of FIG. 7;

FIG. 9 is a section view taken along line 9—9 of FIG. 7;

FIG. 10 is a partial section view taken along line 10—10 of FIG. 4;

FIG. 11 is an elevation view of a mounting tab member forming a part of the chair frame assembly of FIG. 2, for use in mounting the glide member of FIG. 7;

FIG. 12 is an exploded sectional view illustrating a front glide assembly incorporated into the chair assembly of FIG. 1;

FIG. 13 is a rear elevation view of the glide member of FIG. 12, with reference to line 13—13 of FIG. 12;

FIG. 14 is a front elevation view of the glide member of FIG. 13, with reference to line 14—14 of FIG. 12;

FIG. 15 is a plan view of a seat support mounting plate forming a part of the chair frame assembly of FIG. 2;

FIG. 16 is a bottom plan view of the seat incorporated into the seat assembly of FIG. 1;

FIG. 17 is a section view taken along line 17—17 of FIG. 16;

FIG. 18 is a section view taken along line 18—18 of FIG. 16;

FIG. 21 is an isometric view of a desk assembly constructed according to the invention;

FIG. 22 is a side elevation view of the desk assembly of FIG. 21;

FIG. 23 is a partial section view showing mounting of the desk top to the upper frame member, showing the components separated from each other;

FIG. 24 is a view similar to FIG. 23, showing the assembled components with reference to line 24—24 of FIG. 22;

FIG. 29 is a bottom plan view of the desk top incorporated into the desk assembly of FIG. 21;

FIG. 30 is a section view taken along line 30—30 of FIG. 29;

FIG. 31 is a top plan view of a desk top similar to that shown in FIG. 27, illustrating an alternative embodiment for the desk top;

FIG. 32 is a partial section view taken along line 32—32 of FIG. 31;

FIG. 38 is a bottom plan view of a center section incorporated into the desk top of the double desk assembly of FIG. 34;

FIG. 39 is a side elevation view of the center section of FIG. 38;

FIG. 40 is a section view illustrating the center section of FIGS. 38 and 39;

FIG. 41 is an enlarged section view, with reference to line 41—41 of FIG. 39;

FIG. 43 is an isometric view of a tablet arm chair assembly constructed according to the invention;

FIG. 44 is an isometric view of a frame incorporated into the table arm chair assembly of FIG. 43;

FIG. 45 is a side elevation view of the tablet arm chair assembly of FIG. 43;

FIG. 57 is an isometric view illustrating the storage box of FIG. 51 as engaged with a desk top;

FIG. 58 is a view similar to FIG. 57, showing movement of the storage box and the mouse support member of FIG. 55;

FIG. 59 is an isometric view of the storage box of FIG. 51 as engaged with a desk assembly;

FIG. 60 is an isometric view similar to FIG. 58, showing the mouse support member in its retracted, inoperative position;

FIG. 61 is an isometric view illustrating removal of the storage box of FIG. 51 from the desk top; and FIG. 62 is an isometric view illustrating a series of storage boxes as in FIG. 51 stacked upon each other for storage.

DETAILED DESCRIPTION OF THE INVENTION

Figure 19:
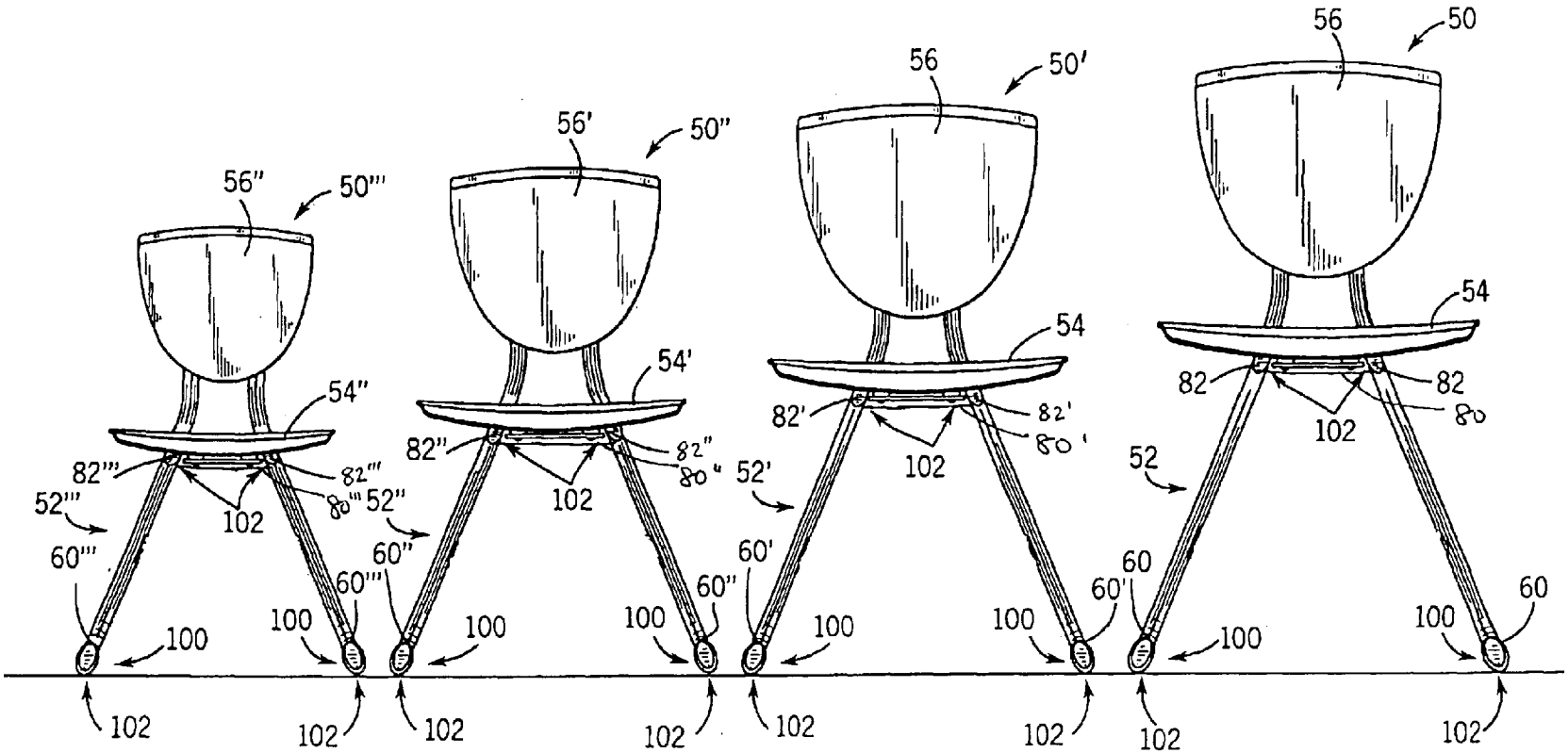
FIG. 19 is a view showing front elevations of chair assemblies of varying sizes constructed according to the invention.

FIG. 1 illustrates a chair 50 constructed according to the invention. Chair 50 includes a frame assembly 52 to which a seat 54 and a back 56 are mounted. Chair 50 is well suited for use in an educational environment, although it is understood that chair 50 may be used in any satisfactory setting.

Referring to FIG. 2, frame assembly 52 is formed of a pair of side frame sections 58, which are mirror images of each other. Each side frame section 58 defines a lower horizontal base section 60 and an upright 62, between which a bend 64 is located. Upright 62 terminates in an upper end 66. Base section 60 and upright 62 define an angle of approximately 88°, and upright 62 and upper end 66 define an angle of approximately 153°. Upper end 66 extends at an angle of approximately 105° relative to base section 60. Each side frame section 58 is formed of a bent elliptical metal tubing material, although it is understood that other satisfactory materials and forming methods could be employed.

Side frame sections 58 are oriented such that base sections 60 extend parallel to each other in a front-rear direction. Uprights 62 extend toward each other in an upward direction, defining an angle of approximately 42°. Each upright 62 includes a bend 70 toward its upper end, and bends 70 are oriented such that upper ends 66 of uprights 62 are parallel to each other when viewed from the front or rear.

An inverted U-shaped handle member 72 is connected to upper end 66 of each side frame section 58. Referring to FIGS. 3 and 5, handle member 72 defines an upper horizontal section 74 and a pair of depending side sections 76. Each side frame section 58 is preferably formed of a tubular material defining an internal passage throughout its length, and a lower end of each handle side section 76, which includes a series of ridges 77, is received within the upwardly open internal passage defined by upper end 66 of each upright 62. Handle member 72 functions to secure side frame sections 58 together at their upper ends and to span across the space therebetween.

Each handle side section 76 is curved outwardly toward its upper end adjacent upper horizontal section 74 and curves inwardly at its lower end adjacent upper end 66 of one of uprights 62. With this construction, handle member 72 defines an open area 78 below upper horizontal section 74 and between side sections 76, for providing a convenient and ergonomic hand grip area for use in lifting and moving chair 50.

A transverse cross-brace member 80 (FIGS. 1–3) extends between uprights 62 at the level of seat 54 and above base sections 60. Cross-brace member 80 is secured at its ends to the inner facing surfaces of uprights 62 in any satisfactory manner, such as by welding. In combination with handle member 72, cross-brace member 80 functions to secure side frame sections 58 together into frame assembly 52 for chair 50.

A seat support member 82 extends forwardly from each side frame section 58 at a location below bend 70. Each seat support member 82 extends forwardly from one of uprights 62, in a direction parallel to the longitudinal axis of base section 60. The forward end of each seat support member 82 terminates slightly rearwardly of the forward end of base section 60. In a manner to be explained, seat support members 82 are operable to mount seat 54 to frame assembly 52. Seat support members 82 are preferably formed of the same material as side frame sections 58, and are connected thereto in any satisfactory manner such as by welding.

Referring to FIGS. 1, 4 and 7–11, a rear glide 84 is mounted to each side frame section 58 at lower bend 64. Each rear glide 84 defines a slot 86 which receives a tab 88 welded to side frame section 58 at bend 64. An opening 89 is formed in the inner surface of glide 84 for receiving a screw 90, which is engaged within one of threaded openings 91 formed in tab 88. With this arrangement, glide 84 is easily mounted to side frame section 58, and easily removed when necessary for replacement.

Glide 84 defines a lower engagement edge 92 which engages a supporting surface such as a floor, and a rear edge 94 extending upwardly from engagement edge 92. An arcuate corner 96 is defined between engagement edge 92 and rear edge 94. An upper, forward edge 98 of glide 84 defines a curved, contoured recess adapted to receive the outer, lower portion of side frame section 58 at lower bend 64. Slot 86, which receives tab 88, extends inwardly from the recess in upper, forward edge 98.

Rear glide 84 is configured and mounted to side frame section 58 such that engagement edge 92 is located at an elevation below the lower extent of base section 60, to provide a space between the supporting surface and base 60 when chair 50 is supported on the supporting surface.

Referring to FIGS. 1 and 12–14, a front glide 100 and an end cap 102 are engaged with the forward end of each base section 60. Front glide 100 defines a lower engagement portion 104 and a ring 106 extending upwardly therefrom. End cap 102 defines an outer cap section 108 and an inner mounting section 110 provided with a series of ridges. Ring 106 of front glide 100 defines a passage 111 adapted to receive the end of base section 60, with a shoulder located at the forward portion of ring 106 engaging the end of base section 60. Mounting section 110 of end cap 102 is adapted to pass through the open area defined by ring 106 and into the open front end of base section 60, for mounting both front glide 100 and end cap 102 to the forward end of base section 60. Cap section 108 of end cap 102 is configured so as to engage ring 106 outwardly of the open area defined by ring 106, which defines a recess R for receiving a peripheral outer flange F of cap section 108 which extends outwardly of mounting section 110. Mounting section 110 is sized and configured so as to closely correspond to the shape of the internal passage defined by base section 60, and the ridges of mounting section 110 provide a friction fit mounting of end cap 102 and front glide 100 to the forward end of base section 60.

Front glide 100 is preferably formed of a thermoplastic material such as Santoprene and end cap 102 is preferably formed of a nylon material, although it is understood that other satisfactory materials may be employed.

An end cap 102 is engaged within the open front end of each seat support member 82, without a glide such as 100. Flange F is sized and shaped so as to correspond to the end of seat support member 82. In this manner, end cap 102 functions to close the open forward end of each seat support member 82 and to provide a finished appearance.

Referring to FIGS. 2 and 15, a mounting plate 112 is mounted between seat support members 82 toward the outer end of each mounting member 82. As shown in FIGS. 4 and 16, mounting bosses 114 depend from the underside of seat 54. A threaded fastener, such as a screw 116, extends through each of a series of openings 117 in mounting plate 112 and upwardly into a downwardly open internal passage 118 defined by each mounting boss 114. With this arrangement, seat 54 is mounted to seat support members 82. Rearwardly of mounting bosses 114, seat 54 defines a downwardly facing rear surface 120 which is spaced slightly above the upper surfaces of seat support members 82.

Referring to FIG. 4, the rear edge of seat 54, shown at 122, is spaced forwardly from the forward surfaces of side frame sections 58. The front edge of seat 54, shown at 124, is located forwardly of the forward ends of seat support members 82. Seat 54 is configured so as to define a rearwardly sloping upwardly facing support surface 126 having an angle of approximately 8° relative to horizontal, i.e. relative to the longitudinal axes of seat support members 82 and base sections 60. The rearward slope of seat 54 functions to resist forward sliding of the user when seated in chair 50. Seat 54 is nearly flat in a transverse direction, so as to allow a user to sit in various positions without pressure at the edges of seat 54. In addition, the flatness of seat 54 accommodates off-center sitting and varying body shapes, and reduces pressure on softer body tissues which may otherwise cause circulatory discomfort.

The forward portion of seat 54, shown at 128 (FIGS. 17, 18) slopes forwardly at an angle of approximately 5° relative to horizontal, commencing slightly rearwardly of the forward mounting bosses 114. The front of seat 54 at front edge 124 defines a "waterfall", providing easy ingress and egress to and from seat 54.

Referring to FIGS. 4, 5 and 6, a pair of mounting bosses 132 extend rearwardly from the rear surface of back 56. Each mounting boss 132 is located adjacent a mounting section of handle member 72, shown at 134, and is adapted to engage a forward area thereof. The rearwardly facing surface of each mounting boss 132 is configured so as to correspond to the external configuration of the forward area of mounting section 134. Threaded fasteners, such as screws 136, extend through openings in each mounting section 134 and into one of a pair of passages 138 defined by mounting boss 132. The passage in mounting section 134 defines a shoulder for engaging the head of screw 136. With this arrangement, screws 136 are operable to engage mounting bosses 132 at each side of handle member 72, for securely mounting seat 56 to and between handle member side sections 76.

Back 56 defines a lower edge 142 located above seat support members 82 and above the seat rear edge 122. In addition, back 56 defines an upper edge 144 located above the upper end of handle member 72. The upper area of back 56 which is engaged by a user's back, i.e. the area of back 56 located at and above the location of mounting bosses 132, is oriented at an angle of approximately 15° relative to vertical in order to relieve muscular fatigue on the user.

The rear portion of seat 54 and the upper portion of back 56 cooperate to define a sitting angle of approximately 97°. In addition, the 5° forward slope of the forward edge of seat 54 functions to define a trunk/thigh angle which approaches the optimum angle of 135°. This orientation of seat 54 and back 56 has been found to be ergonomically satisfactory and to provide a high degree of comfort for users when sitting for relatively long periods of time, such as can occur in an educational setting.

Upper edge 144 of back 56 defines a slight upward curvature, and also defines the point of maximum width of back 56. The sides of back 56, shown at 146, are curved downwardly and inwardly, terminating at lower edge 142. This shape of back 56 provides a high degree of support for the back of a user with a relatively small amount of material, by eliminating material laterally outwardly from the center of back 56 at the lower areas of back 56.

FIG. 19 illustrates chairs 50, 50', 50" and 50'" constructed according to the invention, and primed reference characters will be used to facilitate clarity. Chair 50' includes a frame assembly 52', and the remaining components of chair 50' are identical to those shown and described with respect to chair 50. Chair 50' is adapted to accommodate a user smaller than the intended users of chair 50. Seat support members 82' of frame assembly 52' are positioned at a lower elevation than in frame 52, and the overall height of frame 52' is less than that of frame 52. The configuration of seat 54 and back 56 are the same for chair 50' as chair 50, as is the angular relationship between seat 54 and back 56. The utilization of common components for chair 50 and chair 50' provides economies in the manufacture of two different chair models intended for different groups of end users.

Chair 50" includes a frame assembly 52" constructed generally similarly to frame assemblies 52 and 52'. Again, however, chair 50" is adapted for use with smaller individuals than chair 50', and thus includes seat support members 82" located closer to base sections 60" and having a lesser height than frame assembly 52'. Chair 50" includes a seat 54' and a back 56', which are similar in shape to seat 54 and back 56, respectively, but of a smaller scale for seating smaller users than are intended for chairs 50 and 50'. The configuration of seat 54' and back 56' is similar to that of seat 54 and back 56, as are the angular relationships between seat 54' and back 56'. Again, handle member 72, rear glides 84, front glides 100 and end caps 102 are the same for chair 50" as for chairs 50 and 50', thus providing an efficient and economical means for producing chairs of varying sizes with common components.

Chair 50'" is adapted to accommodate even smaller individuals than chair 50". Chair 50'" includes a frame assembly 52'" which again has a similar overall configuration as frame assemblies 52, 52' and 52". Again, however, the seat support members 82'" are located at a lower elevation relative to base sections 60'". In addition, the overall height of frame assembly 52'" is less than that of frame assembly 52". With this arrangement, seat 54" is placed at a low elevation relative to the floor or other supporting surface, and back 56" is positioned so as to accommodate the back of such a user. Again, seat 54" and back 56" each have a similar configuration as seats 54, 54' and back 56, 56', respectively, to provide the same ergonomic advantages as set forth above. The angular relationships between seat 54" and back 56" are also the same as described above with respect to seat 54 and back 56. As before, handle member 72, rear glides 84, front glides 100 and end caps 102 are the same components as shown and described previously, to provide efficiencies in the manufacture of chairs 50, 50', 50" and 50'".

FIG. 19 illustrates chairs 50, 50', 50" and 50'" in a side-by-side manner, which well illustrates the difference in the chair sizes and the capability of chairs 50–50'" to handle differently sized individuals while utilizing a large number of common components for chairs of various sizes.

Figure 20:
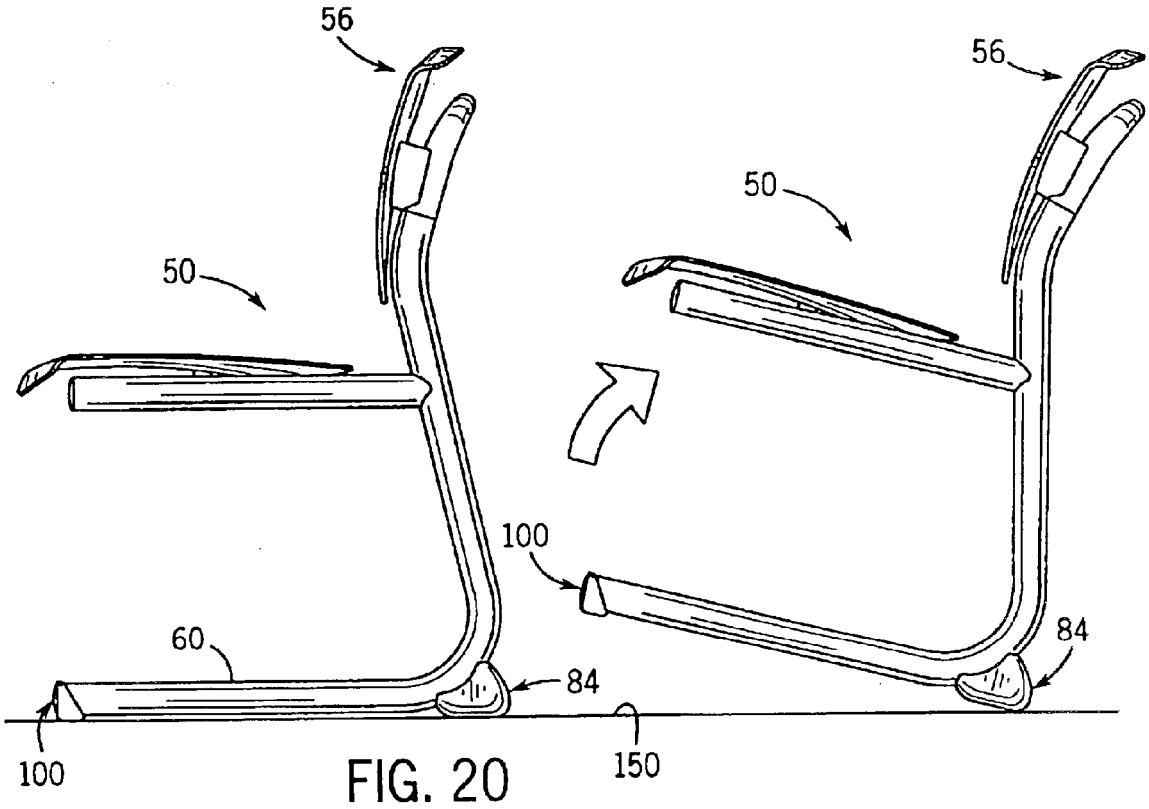
FIG. 20 is a view illustrating the construction of the chair assembly of the invention and its ability to resist tipping.

FIG. 20 illustrates the operation of rear glides 84 in providing stability for a chair such as 50. Rear glide 84 engages the floor or other supporting surface 150, along with front glide 100, to normally support chair 50 in use. Glides 84, 100 are configured so as to space the base section 60 of frame assembly 52 above supporting surface 150. When the user leans back against back 56 and pushes upward on supporting surface 150 to rock chair 50, as shown in the right hand portion of FIG. 12, front glide 100 is lifted off supporting surface 150. Rear glide 84 engages supporting surface 150 at a location rearward of back 56 and therefore well rearward of the user's center of gravity during such normal rocking motion of chair 50, to prevent chair 50 from tipping over. The configuration of rear glide 84 is such as to discourage backward rocking of chair 50, in that point contact of rear glide 84 with supporting surface 150 is located at the most rearward possible location on chair 50. This ensures that the user's center of gravity is at all times located forwardly of the contact point between rear glide 84 and supporting surface 150 during rearward rocking movement of chair 50. Rear glide 84 is preferably formed of a rigid material such as glass filled nylon, although it is understood that other materials may be used.

While FIG. 20 illustrates operation of glides 84 in connection with chair 50, it is understood that similar operation occurs with respect to chairs 50', 50" and 50'" so as to prevent chair tipping during rocking movement of the chair.

FIGS. 21 and 22 illustrate a desk 152 constructed according to the invention. Desk 152 includes a frame assembly 154 and a top 156, and is especially well suited for use with chairs such as 50, 50', 50" and 50'" in an educational setting, although it is understood that the desk and chairs may be used in any setting as desired.

Figure 25:
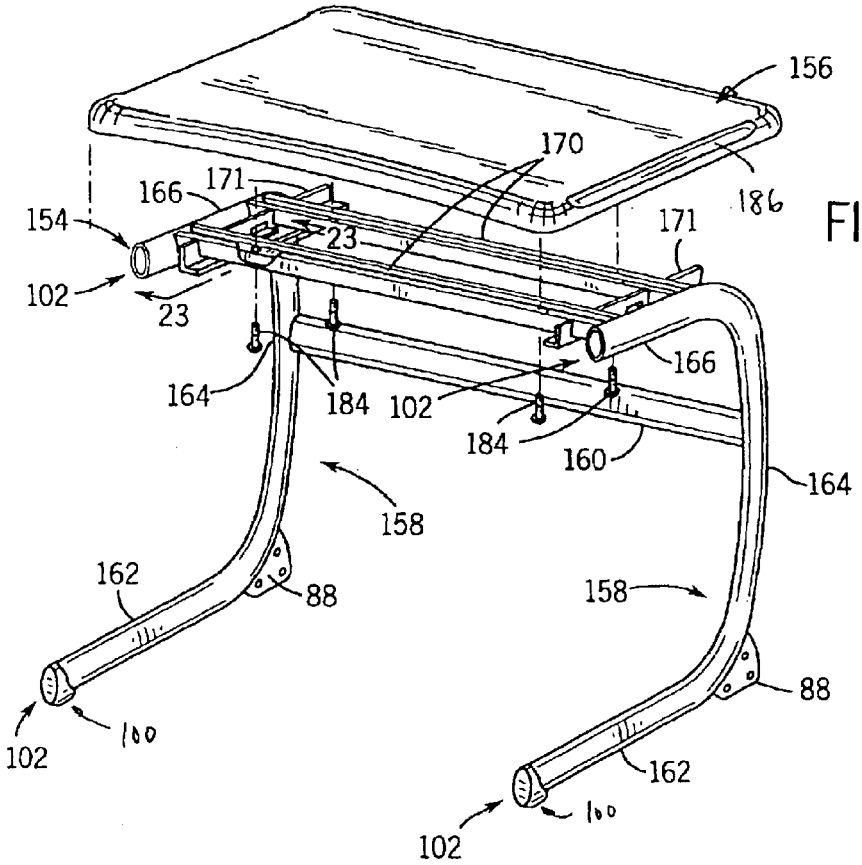
FIG. 25 is an exploded isometric view illustrating the desk frame assembly and the desk top incorporated in the desk assembly of FIG. 21.
Figure 26:
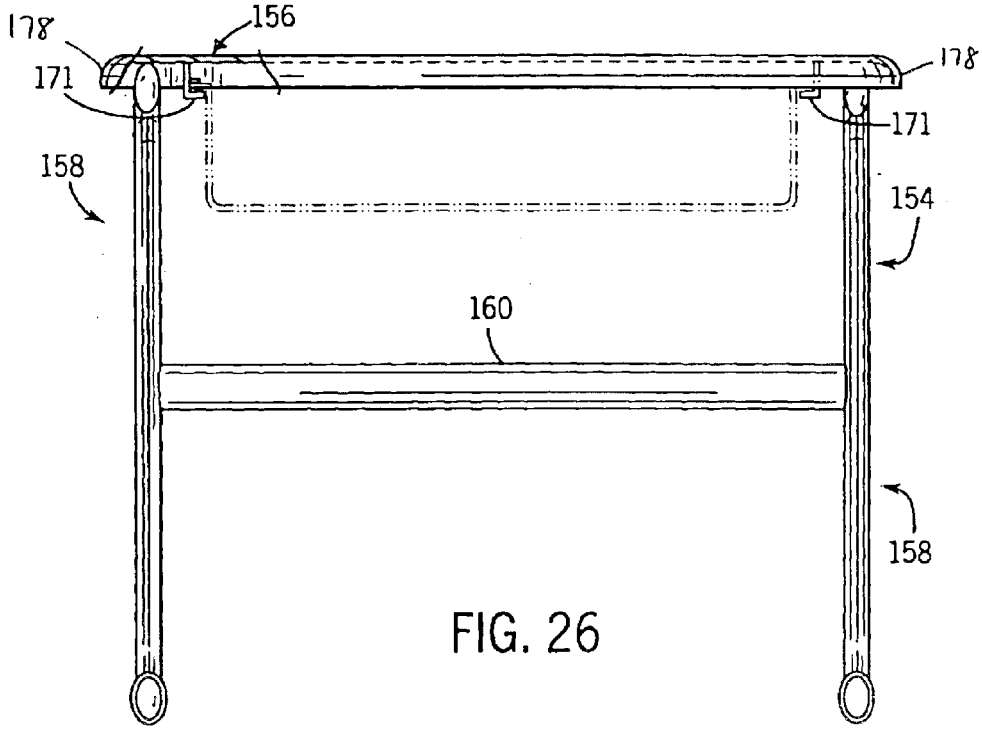
FIG. 26 is a rear elevation view of the desk assembly of FIG. 21.
Figure 28:
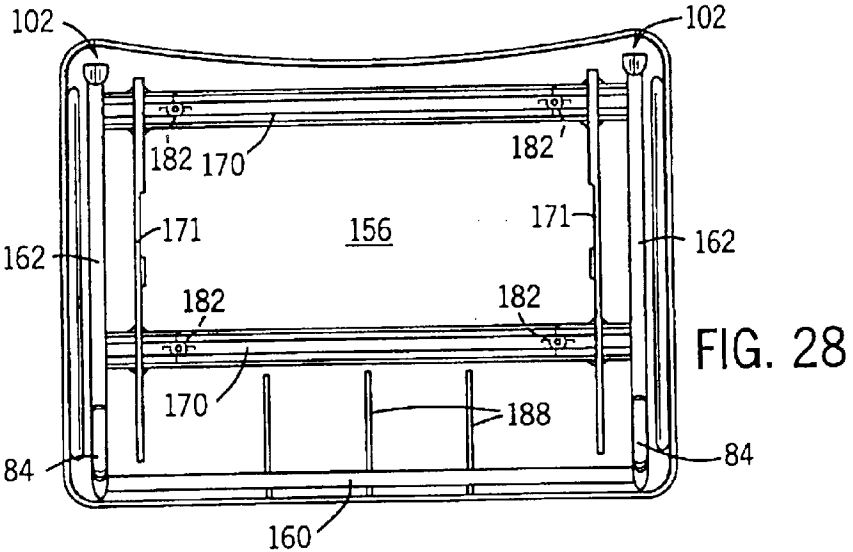
FIG. 28 is a bottom plan view of the desk assembly of FIG. 21.
Figure 27:
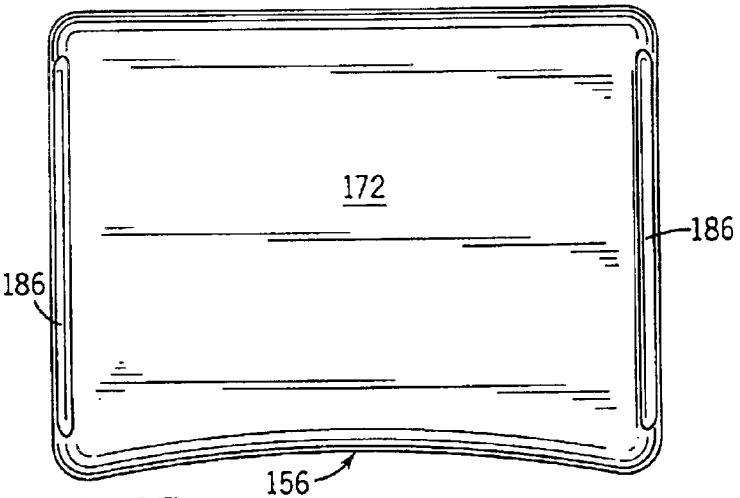
FIG. 27 is a top plan view of the desk top incorporated in the desk assembly of FIG. 21.

Referring to FIGS. 21, 22 and 25, frame assembly 154 consists of a pair of C-shaped side frame sections 158 in combination with a cross-brace member 160 extending therebetween. Each side frame section 158 includes a base section 162, an upright section 164 and an upper section 166 to which top 156 is mounted, in a manner to be explained. A lower bend 168 is located between base section 162 and upright section 164, and an upper bend 169 is located between upright section 164 and upper section 166. Each side frame section 158 is preferably formed of a bent elliptical metal tubing material, although it is understood that other satisfactory materials and forming methods could be employed.

As shown in FIG. 22, front glide 100 and end cap 102 are engaged with the open forward end of each base section 162, in the same manner as described above with respect to frame assembly 52 of chair 50. Similarly, a rear glide 84 is mounted to a mounting tab 88 secured to each side frame section 158 at lower bend 168, in the same manner as described above with respect to frame assembly 52 and chair 50. In this manner, glides 84, 100 function to support base section 162 above the floor or other supporting surface, and prevent tipping of desk 152.

Side frame sections 158 are spaced apart from each other and lie in parallel planes, and the space between side frame sections 158 is sufficient to accommodate a chair and a user. Cross-brace member 160 is preferably formed of the same tubular material as used to form side frame sections 158, and is connected to side frame sections 158 in any satisfactory manner, such as by welding.

Referring to FIG. 25, frame assembly 154 further includes a pair of parallel cross members 170 which extend between upper sections 166. Each cross member 170 has a pair of spaced openings, and is connected at its ends to upper sections 166 in any satisfactory manner such as by welding. A pair of rails 171 are mounted to cross members 170, extending in a front-rear direction perpendicularly to cross members 170 and parallel to upper sections 166. The function of rails 171 will later be explained.

Desk top 156 is preferably an injection molded plastic member, although it is understood that other satisfactory materials and forming methods may be employed. Desk top 156 defines a top wall 172, depending front and rear lips 174, 176, respectively, and depending side lips 178 extending between front and rear lips 174, 176.

As shown in FIGS. 22–24 and 28–30, a series of mounting bosses 182 depend from upper wall 172 of desk top 156, and each defines a passage adapted to receive a threaded fastener such as a screw 184 which extends through an opening in one of cross members 170 into engagement with a passage in one of mounting bosses 182, so as to secure desk top 156 to frame assembly 154.

A pair of pencil troughs 186 are formed in top wall 172 at its side edges. In addition, a series of reinforcing ribs 188 (FIGS. 28–30) are formed integrally with desk top 156 for adding rigidity to top wall 172.

FIG. 31 illustrates an alternative desk top 156', which is generally similar in construction to desk top 156 as illustrated in FIGS. 21–28. Desk top 156' includes a recessed top wall 190, which is adapted to receive an insert 192, illustrated in FIG. 20. The recess of top wall 190 is shallow and flat, and is defined by inner edges of front, rear and side lips 174, 176 and 178, respectively. Insert 192 is placed within the recess and is secured in position in any satisfactory manner, such as by use of an adhesive. Insert 192 provides a hard, smooth surface suitable for writing and for withstanding scratches, bumps and other forces to which the upper surface of desk top 156' is subjected during use. In addition, insert 190 provides the capability of applying a logo, guidelines, lettering or numbering to the upper surface of desk top 156' by application to insert 192, in a manner as is known.

Figure 33:
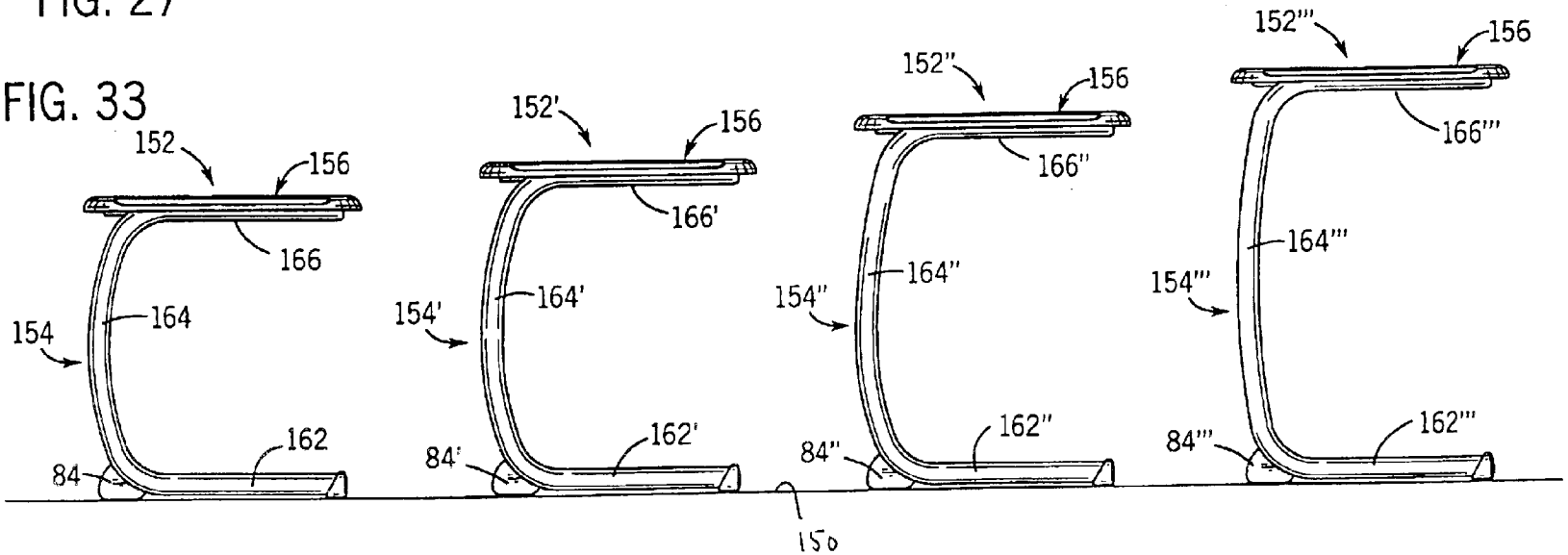
FIG. 33 is a view illustrating various sizes of the desk assembly constructed according to the invention such as is shown in FIG. 21.
Figure 34:
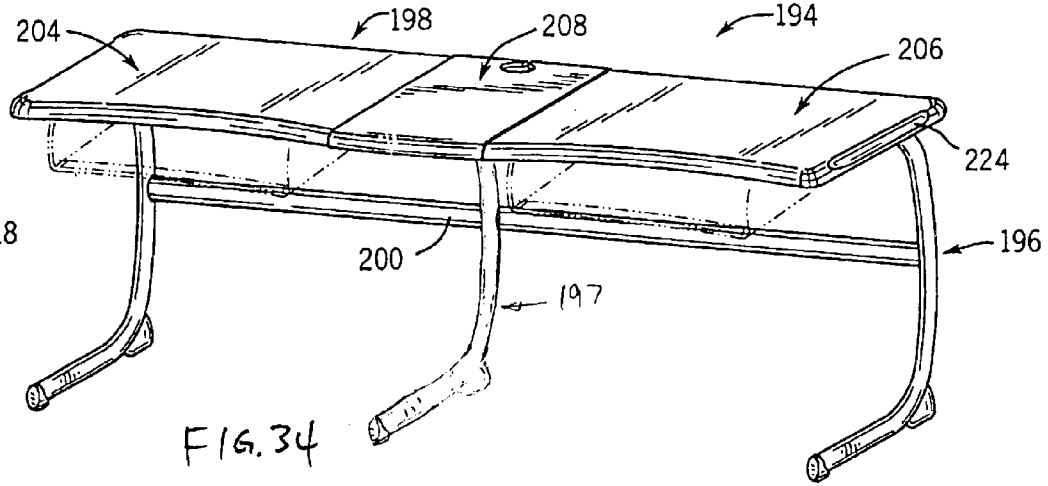
FIG. 34 is an isometric view of a double desk constructed according to the invention.

FIG. 33 illustrates desk 152, along with desks 152', 152" and 152'", which have the same general construction as desk 152'. As can be seen, however, desks 152', 152" and 152'" increase in height relative to desk 152 and relative to each other, for accommodating different chair heights and sizes of users. Desks 152, 152', 152" and 152'" each employ the same desk top 156 as desk 152, and each includes a frame assembly having an increasing height for locating top 156 at increasingly higher elevations above the supporting surface 150. Each frame assembly, shown at 154', 154" and 154'" for desks 152', 152" and 152'", respectively, has a pair of side frame sections with base sections and upper sections configured similarly to base section 162 and upper section 166 of frame assembly 154, and the height of the upright section of each such side frame section varies to provide the desired height of desk top 156 above the supporting surface, shown at 150. With this arrangement, it can be appreciated that a variety of desk heights can be provided utilizing a single desk top 156 while only slightly varying the construction and configuration of the desk frame assembly, according to the targeted end users of the desk.

FIGS. 34–42 illustrate a double desk 194 constructed according to the invention. Double desk 194 includes a frame assembly 196 and a top assembly 198, and is adapted for use with a pair of chairs.

Figure 36:
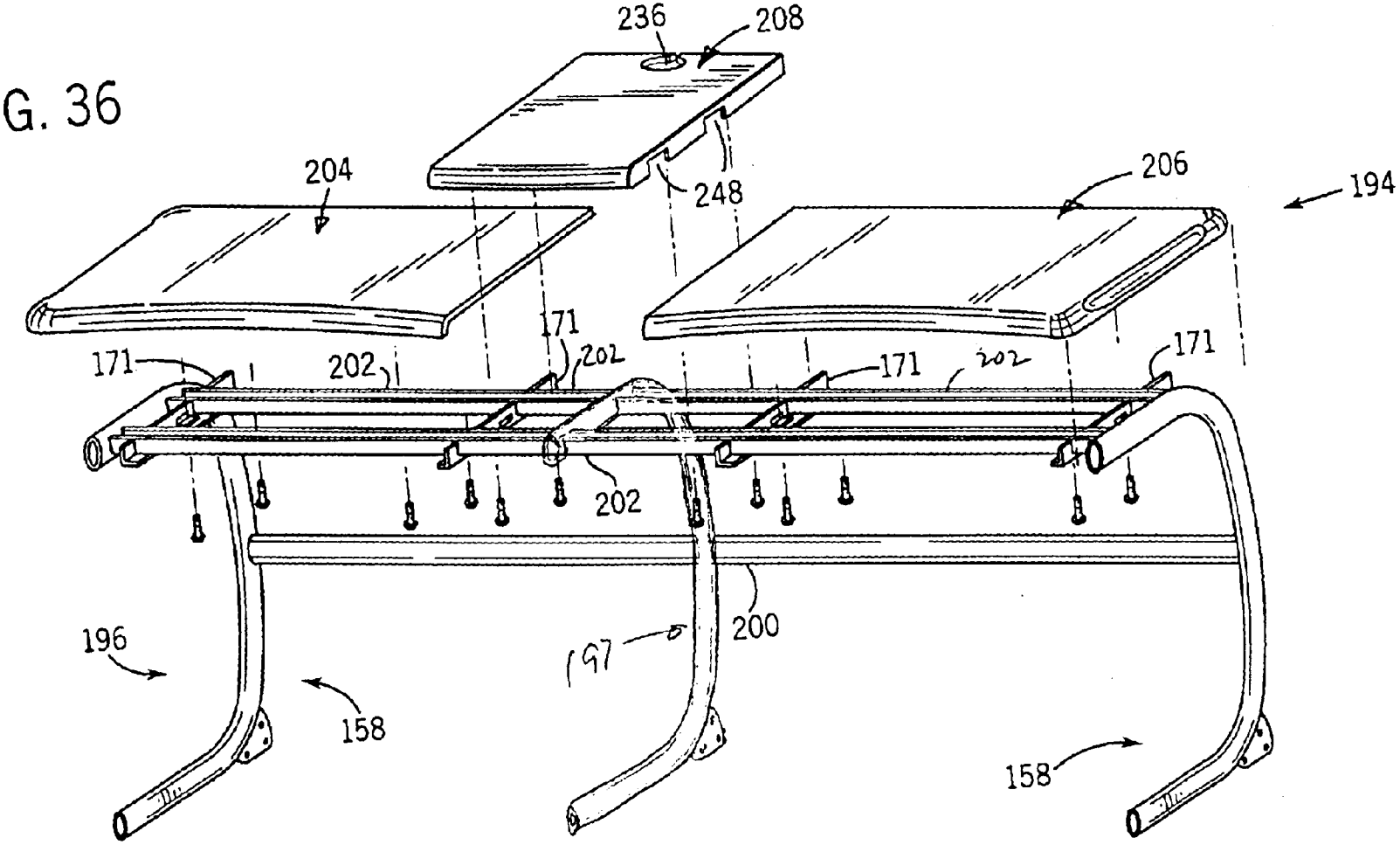
FIG. 36 is an exploded isometric view of the double desk of FIG. 34.

Referring to FIG. 36, frame assembly 196 of double desk 194 is constructed similarly to frame assembly 154 of desk 152, in that frame assembly 196 includes the same pair of side frame sections 158 as incorporated in frame assembly 154, as well as an intermediate frame section 197 constructed similarly to frame sections 158. Frame assembly 196 differs from frame assembly 154 in that two cross-brace members 200 are connected between side frame sections 158, as are cross members 202. Cross-brace members 200 and cross members 202 are of sufficient length to space side frame sections 158 apart a sufficient distance to accommodate a pair of chairs therebetween. Spaced pairs of rails 171 are mounted to cross members 202, with each pair being located toward one end of double desk 194 where a chair is adapted to be received. Other than the length of cross-brace member 200 and mounting members 202, and the use of two pairs of rails 171, frame assembly 196 of double desk 194 is constructed the same as frame assembly 154 of desk 152.

Referring to FIGS. 34–37, the top of double desk top assembly 198 is made up of a pair of mirror image desk sections 204, 206 and a center section 208.

Figure 37:
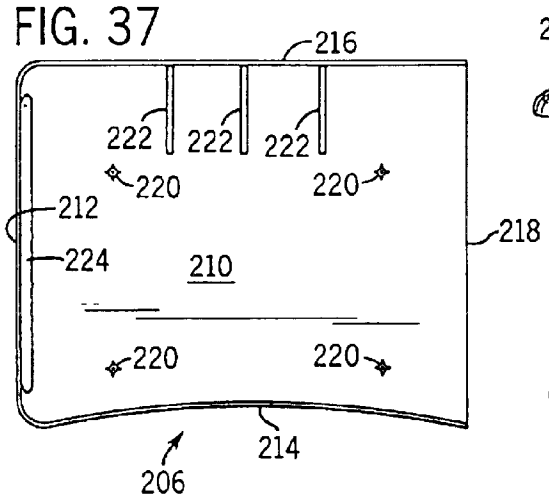
FIG. 37 is a bottom plan view of a desk top end section incorporated into the double desk assembly of FIG. 34.
Figure 35:
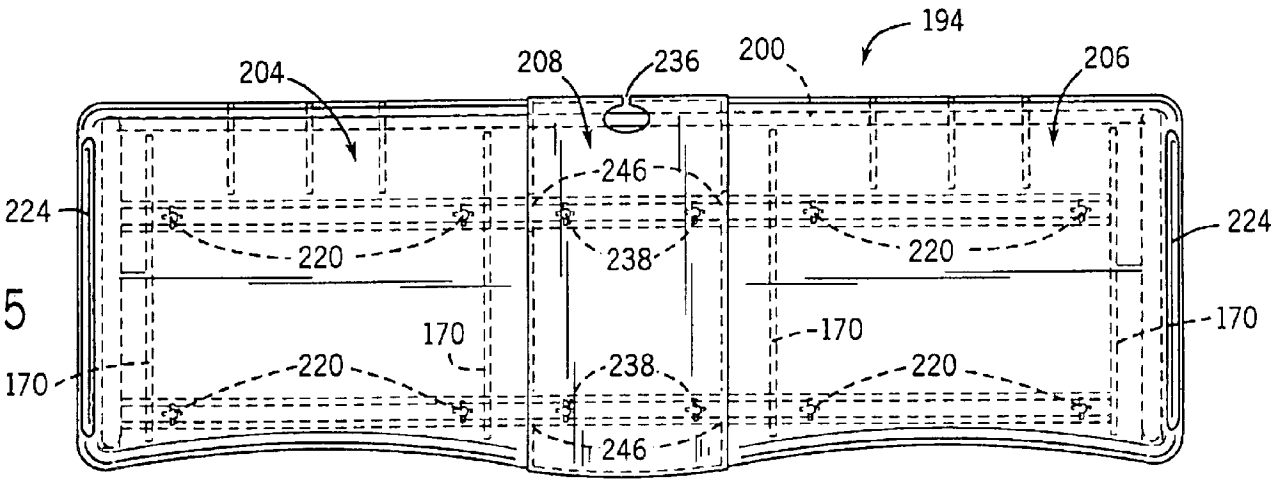
FIG. 35 is a top plane view of the double desk of FIG. 34.

FIG. 37 illustrates the construction of desk sections 204, 206. Details of desk section 206 are illustrated, and it is understood that desk section 204 is similarly constructed and is a mirror image of desk section 206.

Desk section 206 includes a top wall 210, an outer side edge 212 including a depending lip, a front edge 214 having a depending lip and a rear edge 216 having a depending lip. Rear edge 216 is perpendicular to outer side edge 212. Front edge 214 has a slight rearward, concave curvature relative to outer side edge 212. An inner side edge 218 extends between front and rear edges 214, 216, and does not include a depending lip.

A series of depending mounting bosses 220 extend downwardly from top wall 210, and reinforcing ribs 222 extend below top wall 210 inwardly from rear edge 216, terminating rearwardly of the rear set of mounting bosses 220. A pencil trough 224 is formed in top wall 210 adjacent outer side edge 212.

Referring to FIG. 38, center section 208 includes a top wall 226, a front edge including a lip 228, a rear edge including a lip 230, and a pair of side edges 232. An opening 234 is formed in top wall 226 toward rear edge 230, and is accessible through a channel 236. Opening 234 is adapted to receive cords or cables from a computer, monitor, mouse, keyboard or other electrical or electronic device which may be supported on desk sections 204, 206 or center section 208. Channel 236 enables such cords or cables to be passed into opening 234 from rear edge 230.

Center section 208 further includes a series of mounting bosses 238 which extend downwardly from the underside of top wall 226. Each mounting boss 238 defines a downwardly opening passage 240. Center section 208 further includes a pair of front reinforcing ribs 241 extending rearwardly from front lip 228, a pair of rear ribs 242 extending forwardly from rear lip 230, and a pair of intermediate ribs 244, each of which is located between one of front ribs 240 and one or rear ribs 242. A pair of front gaps 246 are located between front ribs 240 and intermediate ribs 244, and a pair of rear gaps 248 are located between rear ribs 242 and intermediate ribs 244. Front and rear gaps 246, 248 are in alignment with the front and rear pairs of mounting bosses 238, respectively, and receive cross members 202 therein.

In assembly, desk sections 204 and 206 are engaged with cross members 202 at the sides of frame assembly 196, such that mounting members 220 of desk sections 204, 206 are in alignment with openings formed in mounting members 202 for receiving threaded fasteners such as screws. Center section 208 is engaged with cross members 202 between desk sections 204, 206. Center section 208 has a width which enables the side edges 232 of center section 208 to overlap the side edges 218 of desk sections 204, 206, outwardly of ribs 240, 242 and 244. Mounting bosses 238 of center section 208 are aligned with openings in cross members 202, and threaded fasteners such as screws are engaged within passages 240 of mounting bosses 238 for drawing center section 208 downwardly against mounting members 202. This functions to clamp desk sections 204, 206 in position on frame assembly 196, and to provide a strong, unified construction for top assembly 198 of double desk 194.

Figure 42:
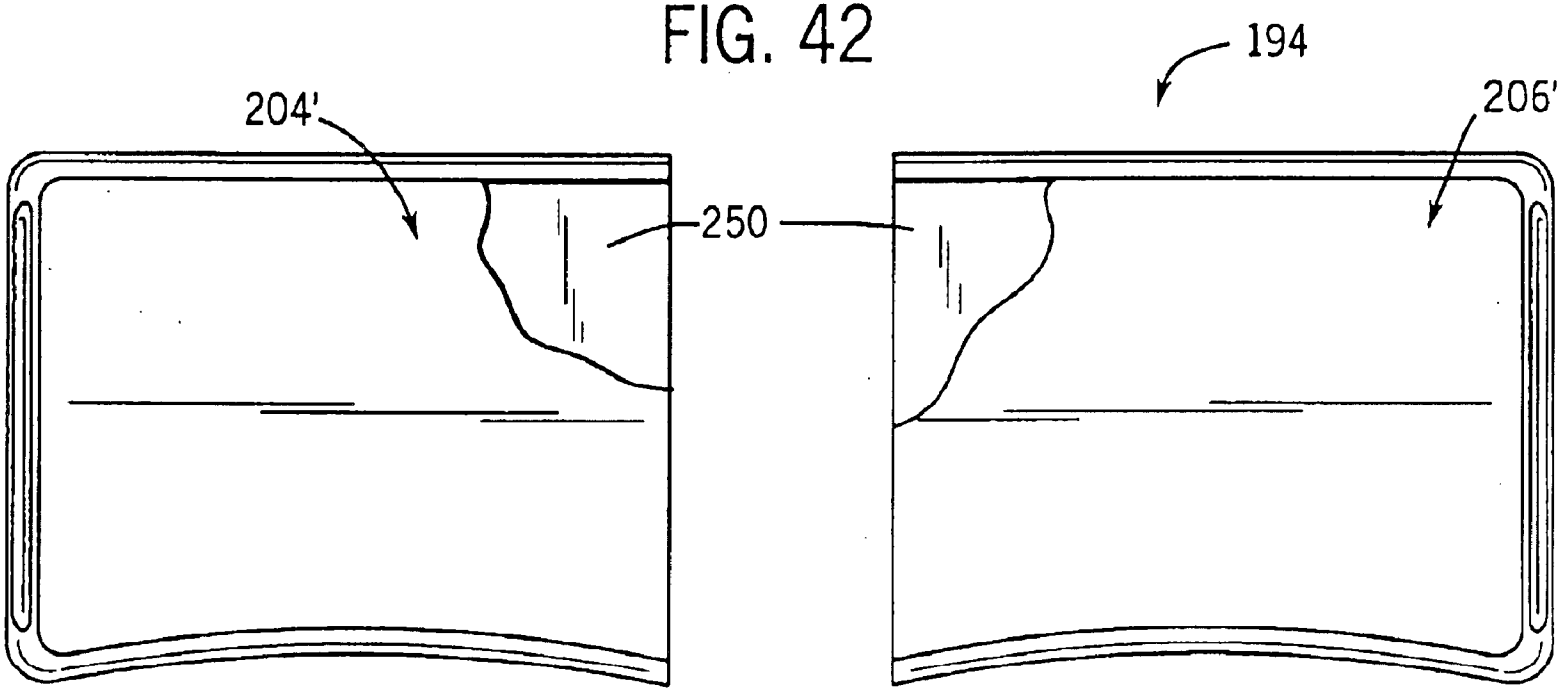
FIG. 42 is a top plan view illustrating an alternative embodiment of a pair of desk sections for incorporating into the double desk assembly of FIG. 34.

FIG. 42 illustrates alternative desk sections 204', 206' which may be used in place of desk sections 204, 206 in double desk assembly 194. Desk sections 204', 206' include a recessed top wall 250, which is adapted to receive an insert in the same manner as described above with respect to desk top 156' (FIGS. 19, 20).

Double desk 194 is adapted to have varying heights in the same manner as illustrated in FIG. 33 with respect to desk assemblies 152, 152', 152" and 152'". In each case, the height of the upright section of side frame section 158 is varied to vary the desk height, and the same desk top assembly including desk sections 204, 206 and center section 208 is used for each desk.

FIGS. 43–45 illustrates a tablet arm chair 252 constructed according to the invention. Tablet arm chair 252 incorporates a frame assembly 254 (FIG. 44) constructed similarly to frame assemblies 52, 52', 52" and 52'" of chairs 50, 50', 50" and 50'", respectively. In tablet arm chair 252, a front upright 256 extends upwardly from the forward end of one of base sections 60, and is interconnected at its upper end with a forwardly extending tablet arm support member 258. A front glide mounting tab 88' is mounted to the frame side section which includes upright 256, at a bend 259 located between base section 60 and upright 256. A front glide 84' (FIG. 43) is adapted for mounting to front glide mounting tab 88', in a manner similar to that described above with respect to glide mounting tabs 88 and rear glides 84.

In a preferred form, tablet arm support member 258 and front upright 256 are formed integrally with one of the side frame sections of frame assembly 254, and are bent from the same tubular material as rear upright 62 and base 60. Front upright 256 is located to one side of seat 54, as is tablet arm support member 258. A pair of transverse tablet support members 260 are mounted in cantilever fashion to tablet arm support member 258, extending above and forwardly of the seating area defined by seat 54 and back 56. An end plate 261 extends between and is mounted to the ends of tablet support members 260. A tablet top 262 (FIG. 45) is mounted to support members 258 and 260 via mounting bosses 264, which depend from the top wall of tablet top 262 and which are engaged by threaded fasteners such as screws which extend into recesses formed in support members 258 and 260, and into passages in mounting bosses 264. Tablet top 262 may have a flat top wall, or the top wall of tablet top 262 may be recessed to receive an insert, as described above. A horizontal brace member 265 (FIG. 44) extends between front upright 256 and one of the seat support members, shown at 82, of frame assembly 254, to impart rigidity to front upright 256 and to brace tablet top 262 against movement. At the opposite side of tablet arm chair 252, an upright 267 extends upwardly from the forward end of lower member 60 and is connected at its upper end to one of seat support members 82. A tab 88 and a glide 84 are mounted to the bend between lower member 60 and upright 267.

As with chairs 50, 50', 50", and 50'" and desks 152, 152', 152", 152'", the size and/or length of various components of tablet arm chair 252 may be altered to provide tablet arm chairs of different heights and sizes to accommodate users of different sizes.

Figure 46:
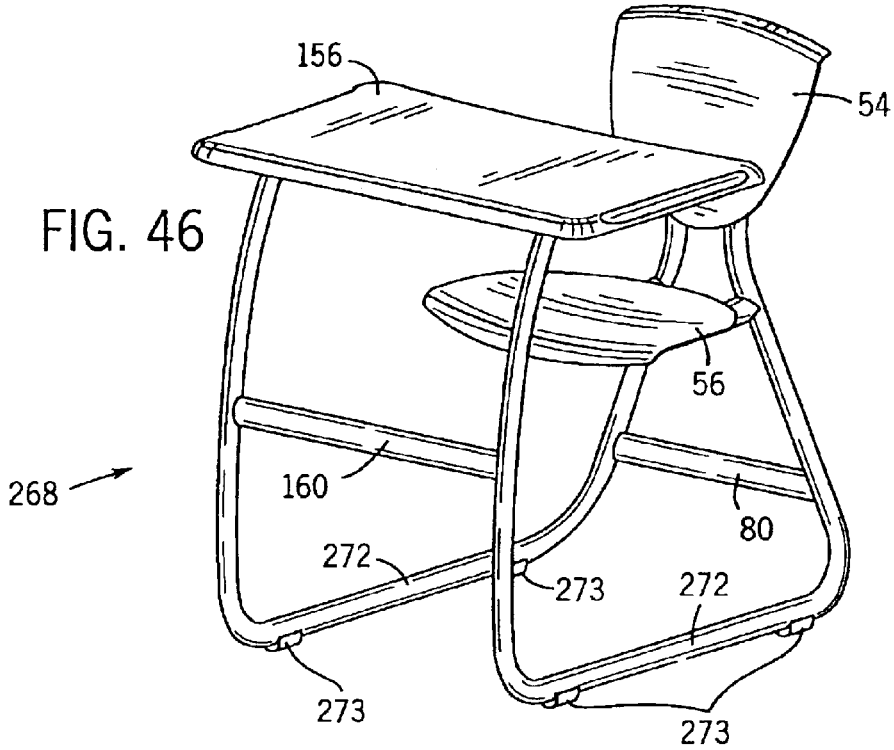
FIG. 46 is an isometric view of a double entry chair/desk unit constructed according to the invention.
Figure 47:
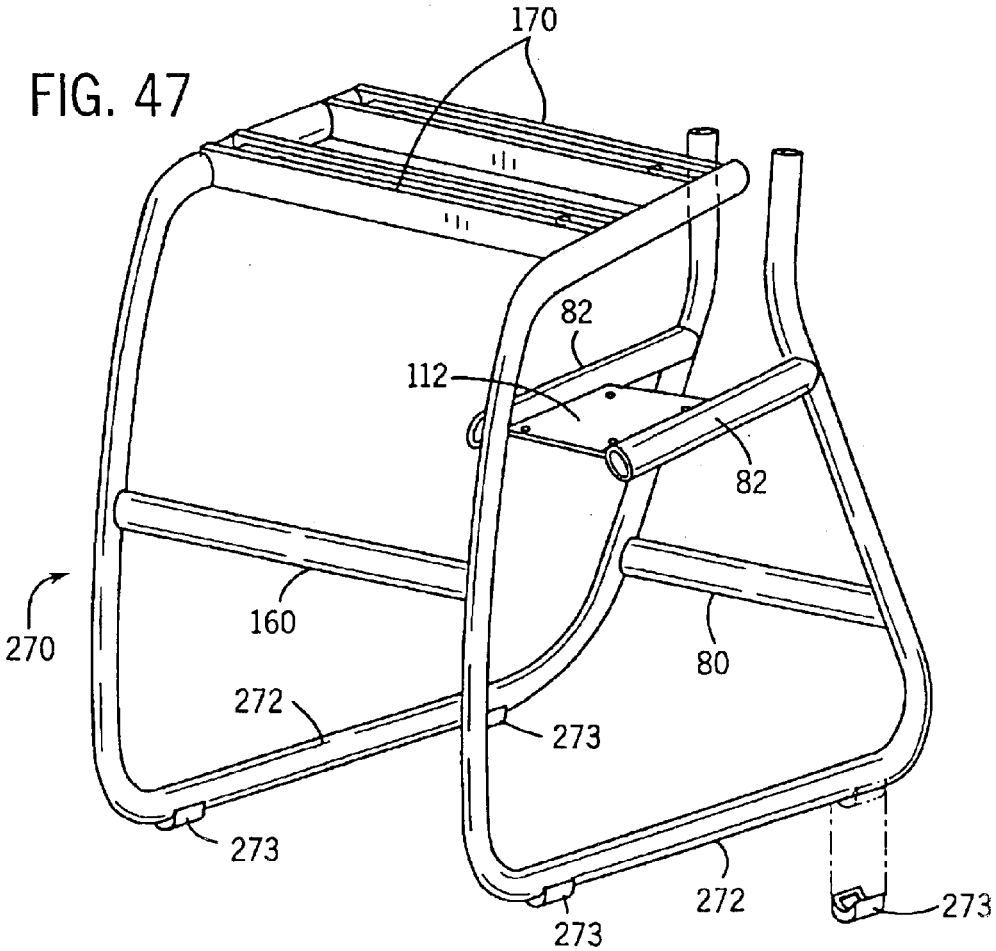
FIG. 47 is an isometric view of a frame assembly incorporated into the double entry chair/desk unit of FIG. 46.

FIGS. 46 and 47 illustrate an open-sided desk assembly 268 constructed according to the invention. Desk assembly 268 includes a combination chair and desk frame assembly 270, which essentially is a combination of a chair frame assembly such as 52, 52', 52" and 52'" with one of desk frame assemblies 154, 154', 154" and 154'". Chair and desk frame assembly 270 includes an elongated base section 272, which corresponds to a chair frame base section, such as shown at 60 with respect to chair frame assembly 52, merged with a desk frame base section 162, with respect to desk frame 154. In this manner, the chair and desk are formed into a single unit providing entry and egress from both sides. Other than the base sections and glides 273 mounted thereto, the components of the chair portion of desk assembly 268 correspond to chair assemblies 50, 50', 50" and 50'", and the components of the desk portion of desk assembly 268 correspond to desk 152.

As shown in FIG. 44, glides 273 are simply arcuate members formed of plastic or any other satisfactory material, mounted toward the front and rear of base section 272 for spacing base section 272 above the floor or other supporting surface. Double faced tape or a suitable adhesive is received within an arcuate upwardly facing recess in each glide 273, and is employed to secure each glide 273 to base section 272.

Again, the size and/or length of various components of desk assembly 268 may be altered to provide desk assemblies of different heights and sizes to accommodate users of different sizes.

The seat, back and desk top components of the various illustrated and described embodiments may be injection molded of a thermoplastic material such as ABS, although it is understood that other satisfactory materials and forming methods may be employed.

Figure 48:
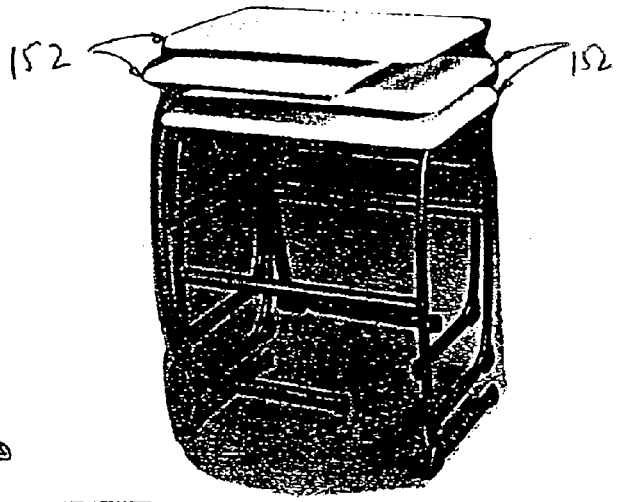
FIG. 48 is a side elevation view illustrating a series of stacked desk assemblies constructed according to the invention.

FIG. 48 illustrates the manner in which four desks, such as 152, 152', 152" or 152'", may be stacked together for storage or cleaning. As shown, the desks are stacked one on top of each other in a spiral configuration. With this arrangement, a stack of desks can be assembled quickly and easily, so as to enable cleaning of the floor space.

Figure 49:
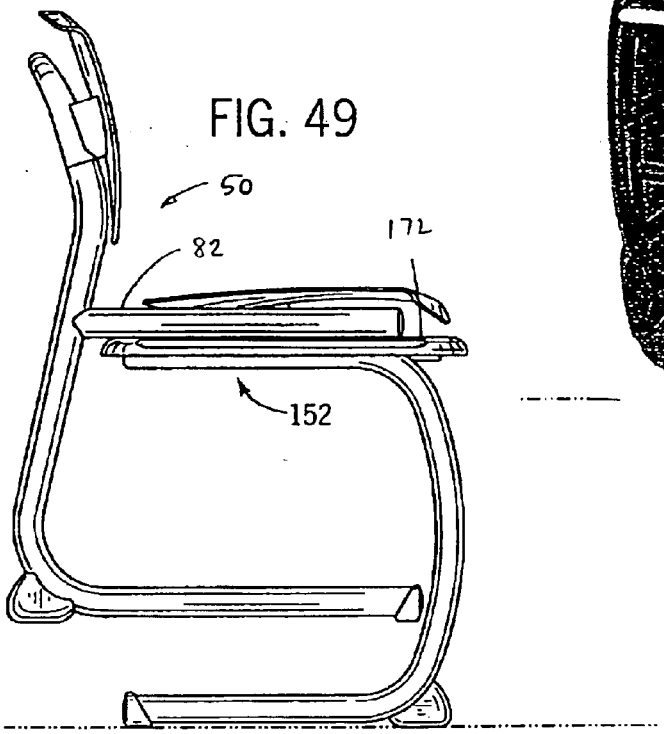
FIG. 49 is a side elevation view illustrating a chair assembly stacked onto a desk assembly.

FIG. 49 illustrates the manner in which a chair can be stacked onto a desk, again for cleaning or storage. As shown, the chair, such as 50, is placed so that its seat support members 82 rest on the top wall 172 of the desk top 156, to suspend the chair from the desk top. In this manner, the legs and base sections of the chair 50 are raised above the floor, so as to allow the space below the desk to be cleaned. This stacking capability further allows compact storage of the chairs and desks.

Figure 50:
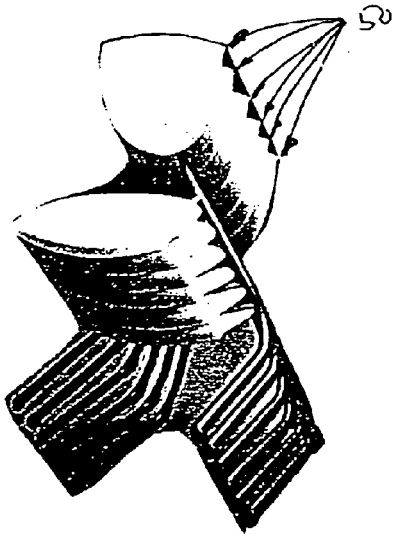
FIG. 50 is an isometric view illustrating a series of chair assemblies constructed according to the invention, in a stacked relationship.
Figure 51:
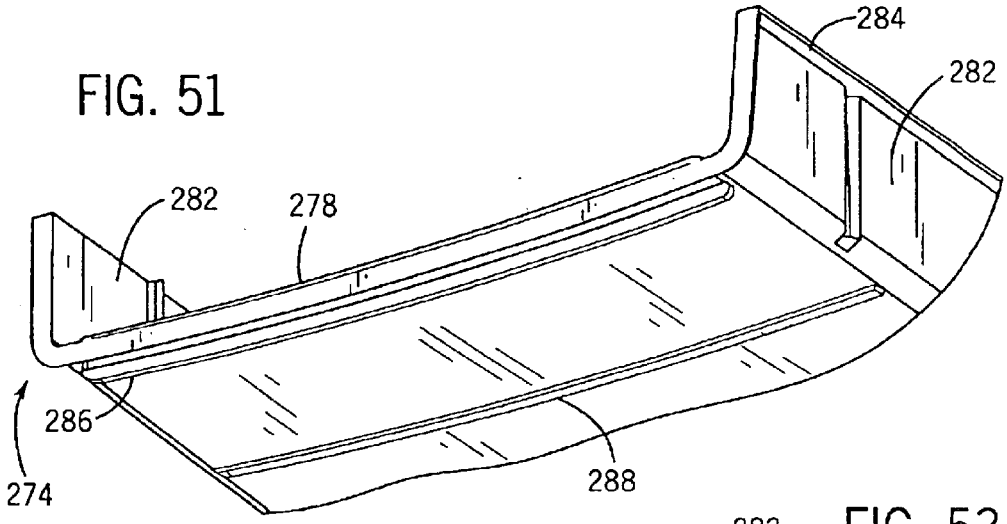
FIG. 51 is a partial isometric view illustrating a storage box adapted for use with the desk assemblies according to the invention.
Figure 53:
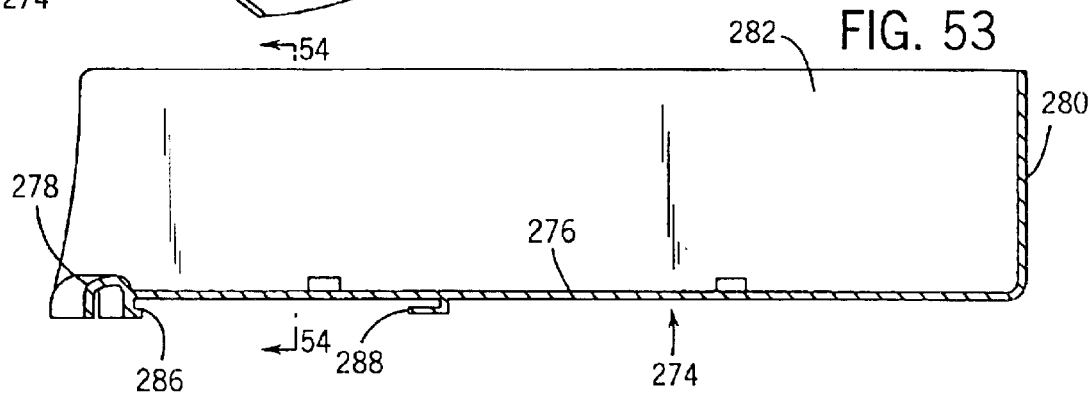
FIG. 53 is a section view taken along line 53—53 of FIG. 52.

FIG. 50 illustrates the manner in which six chairs, such as 50, can be stacked one on top of each other and all facing the same direction, for cleaning purposes or for storage. To stack the chairs 50 in this manner, seat support members 82 of each chair are placed on top of the seat 54 of each chair therebelow. Again, this stacking capability provides a quick and easy way to clear an area for cleaning or to stack the chairs for storage.

FIGS. 51–54 illustrate a tray or box 274 adapted for use with desk top 156 in any of the illustrated desk embodiments. Box 274 includes a floor 276 having a curved front edge provided with an upstanding ridge or raised protrusion 278. A rear wall 280 extends upwardly from the rear end of floor 276, and a pair of side walls 282 extend upwardly from the side edges of floor 276. An outwardly extending flange 284 is provided at the top end of each side wall 282. Front and rear guide tracks 286, 288, respectively, depend from the lower surface of floor 276.

Flanges 284 are adapted to engage rails 171 located below desk top 156 or desk sections 204, 206. With this arrangement, box 274 is engaged with the desk top, such as 156, by aligning flanges 284 above rails 171 and pushing box 274 forwardly, such that flanges 284 ride on rails 171 for supporting box 274 below desk top 156. Box 274 can be removed from desk top 156 by pulling box 274 rearwardly to disengage 274 can be removed from desk top 156 by pulling box 274 rearwardly to disengage flanges 284 from rails 171. In this manner, boxes such as 274 may be selectively utilized in combination with the desk for storing items below the desk top. In addition, boxes 274 may be removed and stacked together for storage.

Figure 55:
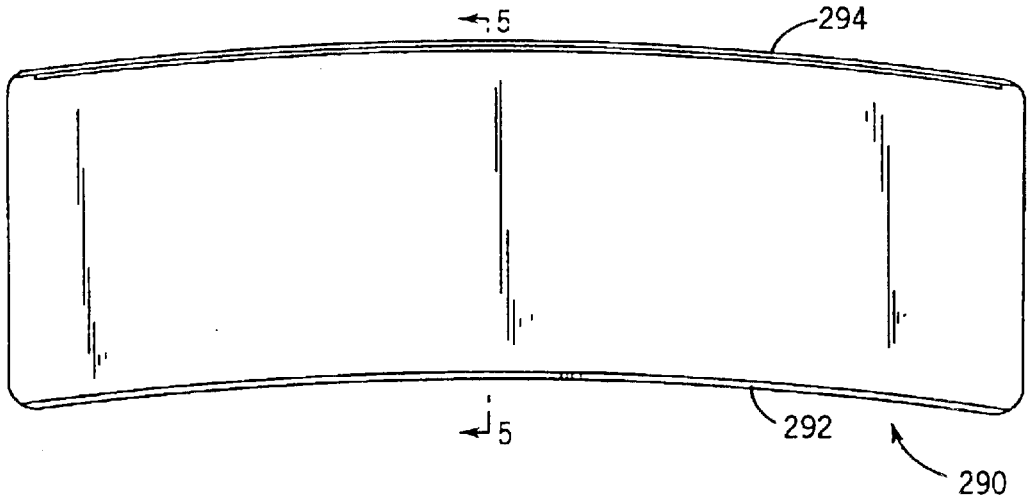
FIG. 55 is a top plan view of a mouse support member adapted for use in combination with the storage box of FIG. 51.
Figure 56:
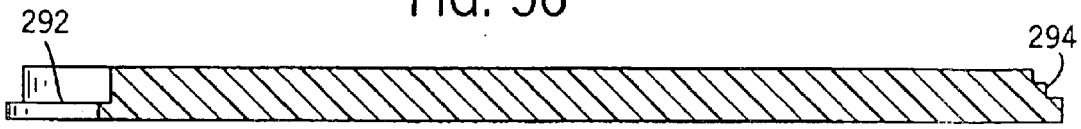
FIG. 56 is a section view taken along line 56—56 of FIG. 55.

FIGS. 55 and 56 illustrate a mouse support member 290 for use in combination with box 274. Mouse support member 290 is in the form of an arcuate planar member having front and rear notches 292, 294 in its front and rear edges, respectively. Notches 292, 294 are adapted for engagement by guide tracks 286, 288 which are located below floor 276 of box 274, so as to mount mouse support member 290 to box 274 for lateral sliding movement. With this arrangement, mouse support member 290 can be moved either leftwardly or rightwardly relative to box 274 so as to expose the end portion of mouse support member 290 outwardly of one of box side walls 282. When a keyboard is received within box 274, the exposed portion of mouse support member 290 is operable to support a computer mouse adjacent the keyboard and below the desk top. When not in use, mouse support member 290 is moved to a retracted position in which both its ends are located below the sides of box 274 and are not exposed.

FIG. 57 illustrates storage box 274 as engaged with the underside of desk top 156. FIG. 59 illustrates the manner in which storage box 274 fits between the side frame sections, such as side frame sections 158, when mounted to the underside of desk top 156.

FIG. 58 illustrates movement of mouse support member 290 relative to box 274. As shown in FIG. 58, mouse support member 290 can be moved rightwardly so that an end portion of mouse support member 290, shown at R, is exposed outwardly of the side area of storage box 274. Alternatively, mouse support member 290 can be slid leftwardly such that the leftward end of mouse support member 290, shown at L, is exposed outwardly of the side area of storage box 274. In this manner, mouse support member 290 can be used to support a computer mouse on either side of storage box 274.

Figure 52:
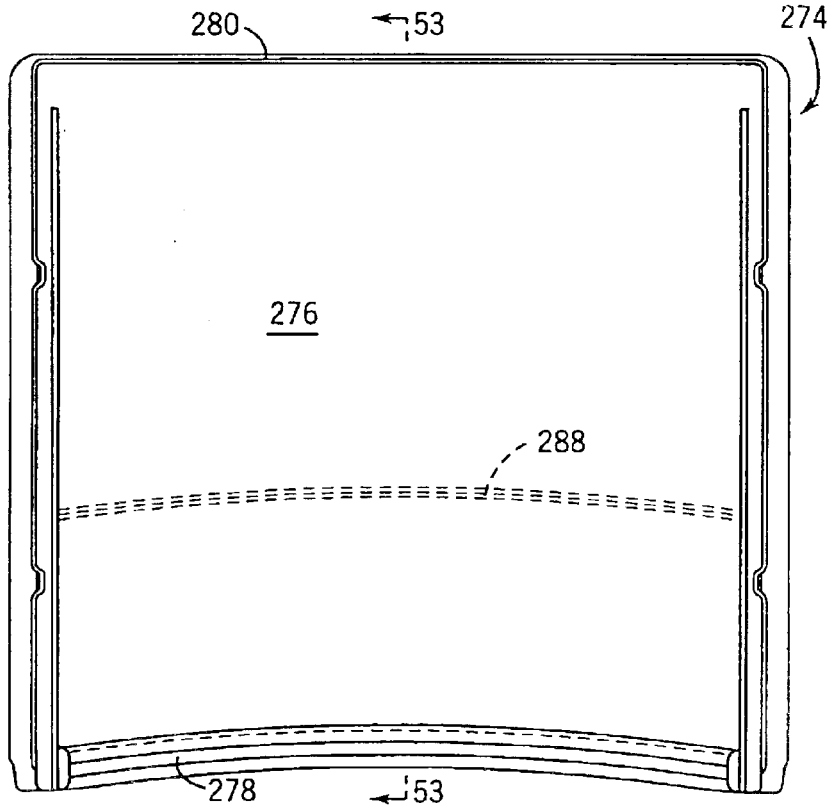
FIG. 52 is a top plan view of the storage box of FIG. 51.
Figure 54:
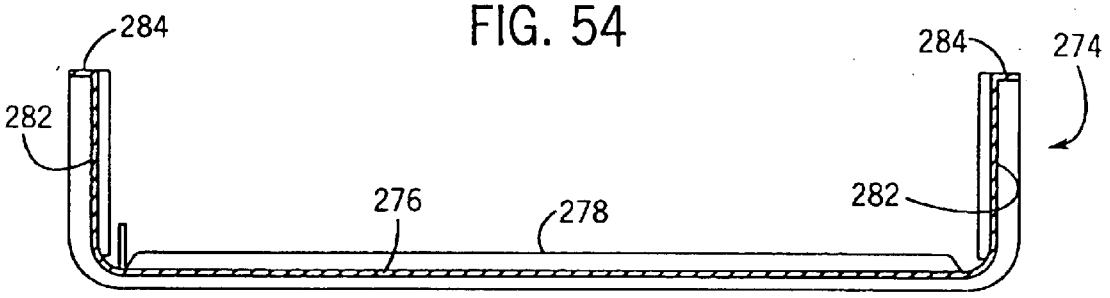
FIG. 54 is a section view taken along line 54—54 of FIG. 53.

FIG. 59 is an isometric view of the storage box of FIG. 52 as mounted to a desk assembly.

FIG. 60 shows storage box 274 with mouse support member 290 in its retracted position, in which both ends of mouse support member 290 are located inwardly of the sides of storage box 274 and movement of storage box 274 rearwardly relative to desk top 156. In this manner, storage box 274 can be moved to provide access to the contents of storage box 274, which may be a computer keyboard or other items typically associated with use of a desk.

FIG. 61 illustrates removal of storage box 274 from desk top 156, and FIG. 62 illustrates the manner in which storage boxes 274 can be stacked upon each other and stored when not in use.

Various alternatives and embodiments are contemplated as being within the scope of the following claims particularly pointing out and distinctly claiming the subject matter regarded as the invention.

We claim:

1. A computer mouse support arrangement for a desk having a desktop that defines an underside, comprising:

a support member including a pair of upstanding side walls and a transverse wall extending between the upstanding side walls, wherein each upstanding side wall is movably engaged with the underside of the desktop for providing movement of the support member between an extended position in which at least a portion of the transverse wall is exposed, and a retracted position in which the transverse walls is located below the desktop, and wherein the transverse wall, the upstanding side walls and the underside of the desktop cooperate to define a cavity that is capable of receiving a keyboard supported by the transverse wall; and a mouse support platform, wherein the mouse support platform defines a pair of end areas and is movably mounted to the support member below the transverse wall for movement between an extended position in which at least one of the end areas of the mouse support platform is exposed outwardly of one of the side walls of the support member, and a retracted position in which the mouse support platform underlies the transverse wall of the support member arid the end areas of the mouse support platform are located inwardly of the side walls.

2. The mouse support arrangement of claim 1, wherein the mouse support platform is movable in either a first direction to a first extended position or in a second direction to a second extended position, wherein the mouse support platform in the first extended position is located so as to expose a first one of the platform end areas outwardly of a first one of the pair of side walls and wherein the mouse support platform in the second extended position is located so as to expose a second one of the platform end areas outwardly of a second one of the pair of side walls.

3. The mouse support arrangement of claim 1, wherein the mouse support platform is movably mounted to the transverse wall via a pair of spaced apart guide flanges interconnected with the transverse wall, and wherein the mouse support platform includes a pair of spaced edges, each of which includes a notch for receiving one of the guide flanges for providing sliding movement of the mouse support platform relative to the transverse wall.

4. The computer mouse support arrangement of claim 1, wherein the support member is movably engaged with the underside of the desktop via a flange located at an upper end defined by each side wall, in combination with a pair of rails engaged with the underside of the desktop, wherein each flange is engaged with one of the rails for providing movement of the support member between the extended and retracted positions.

5. The computer mouse support arrangement of claim 4, wherein the side wall flanges are disengageable from the pair of rails so as to enable the support member to be disengaged from the desktop.

6. The computer mouse support arrangement of claim 1, wherein the transverse wall of the support member defines a forward edge, and further comprising an upwardly extending protrusion extending along the forward edge.

7. The computer mouse support arrangement of claim 1, wherein the transverse wall of the support member defines a forward edge, and further comprising a downwardly facing recess extending along the forward edge, wherein the downwardly facing recess is configured to be engaged by the fingers of a user to facilitate movement of the support member between the extended and retracted positions.

8. A computer mouse support arrangement for a desk having a frame, comprising:

a desktop secured to the frame, wherein the desktop defines an underside and an upwardly facing work surface;

a support member including a pair of upstanding side walls and a transverse wall extending between the upstanding side walls, wherein each upstanding side wall is movably engaged with the underside of the desktop for providing movement of the support member between an extended position in which at least a portion of the transverse wall is exposed, and a retracted position in which the transverse wall is located below the desktop, and wherein the transverse wall, the upstanding side walls and the underside of the desktop cooperate to define a cavity that is capable of supporting a keyboard; and a mouse support platform, wherein the mouse support platform defines a pair of end areas and is movably mounted to the support member below the transverse wall for movement between an extended position in which at least one of the end areas of the mouse support platform is exposed outwardly of one of the side walls of the support member, and a retracted position in which the mouse support platform underlies the transverse wall of the support member and the end areas of the mouse support platform are located inwardly of the side walls.

9. The mouse support arrangement of claim 8, wherein the mouse support platform is movable in either a first direction to a first extended position or in a second direction to a second extended position, wherein the mouse support platform in the first extended position is located so as to expose a first one of the platform end areas outwardly of a first one of the pair of side walls and wherein the mouse support platform in the second extended position is located so as to expose a second one of the platform end areas outwardly of a second one of the pair of side walls.

10. The mouse support arrangement of claim 8, wherein the mouse support platform is movably mounted to the transverse wall via a pair of spaced apart guide flanges interconnected with the transverse wall, and wherein the mouse support platform includes a pair of spaced edges, each of which includes a notch for receiving one of the guide flanges for providing sliding movement of the mouse support platform relative to the transverse wall.

11. The computer mouse support arrangement of claim 8, wherein the support member is movably engaged with the underside of the desktop via a flange located at an upper end defined by each side wall, in combination with a pair of rails engaged with the underside of the desktop, wherein each flange is engaged with one of the rails for providing movement of the support member between the extended and retracted positions.

12. The computer mouse support arrangement of claim 11, wherein the side wall flanges are disengageable from the pair of rails so as to enable the support member to be disengaged from the desktop.

13. The computer mouse support arrangement of claim 8, wherein the transverse wall of the support member defines a forward edge, and further comprising an upwardly extending protrusion extending along the forward edge.

14. The computer mouse support arrangement of claim 8, wherein the transverse wall of the support member defines a forward edge, and further comprising a downwardly facing recess extending along the forward edge, wherein the downwardly facing recess is configured to be engaged by the fingers of a user to facilitate movement of the support member between the extended and retracted positions.

* * * * *